US006458222B1

(12) United States Patent
Matsubara et al.

(10) Patent No.: US 6,458,222 B1
(45) Date of Patent: Oct. 1, 2002

(54) METAL MATERIAL, BRASS AND METHOD FOR MANUFACTURING THE SAME

(75) Inventors: Ryuji Matsubara; Nobuyuki Ashie; Katsuaki Nakamura, all of Kitakyushu (JP)

(73) Assignee: Toto Ltd., Kitakyushu (JP)

( * ) Notice: Subject to any disclaimer, the term of this patent is extended or adjusted under 35 U.S.C. 154(b) by 0 days.

(21) Appl. No.: 09/530,984

(22) PCT Filed: Nov. 11, 1998

(86) PCT No.: PCT/JP98/05076

§ 371 (c)(1),
(2), (4) Date: May 8, 2000

(87) PCT Pub. No.: WO99/24628

PCT Pub. Date: May 20, 1999

(30) Foreign Application Priority Data

Nov. 11, 1997 (JP) ..... 9-326992
Sep. 25, 1998 (JP) ..... 10-270407
Oct. 9, 1998 (JP) ..... 10-288391

(51) Int. Cl.[7] ..... C22C 9/04; C22F 1/08; B21J 5/00

(52) U.S. Cl. ..... 148/433; 148/681; 148/682; 148/685

(58) Field of Search ..... 148/681, 682, 148/685, 433

(56) References Cited

U.S. PATENT DOCUMENTS 5,039,479 A * 8/1991 Bernhard et al. ..... 420/504
5,137,685 A * 8/1992 McDevitt et al. ..... 420/477
5,288,683 A * 2/1994 Nakashima et al. ..... 148/413

FOREIGN PATENT DOCUMENTS

CN 1060052 * 4/1992
DE 19606162 * 8/1997
JP 49-23970 B1 6/1974
JP 55-141552 A 11/1980
JP 60177156 * 9/1985
JP 62130294 * 6/1987
JP 63-9573 B2 2/1988
JP 01079332 * 3/1989
JP 3-110042 A 5/1991
JP 3-170646 a 7/1991
JP 4236734 * 8/1992
JP 7-197150 a 8/1995
JP 7-207387 A 8/1995
JP 7317804 * 12/1995
JP 10-183275 A 7/1998
SU 633693 * 11/1978

OTHER PUBLICATIONS

Frackowiak, J. G.; Ostrowslein D., Moessbauer Effect Study of Copper–Zinc–Tin Alloys, Conf. Appl. Crystallogr., [Proc.] (1984), 11$^{th}$ (vol. 1), 286–90 (Abstract Only), 1984.*

Broichhausen, J.; Feldmann, H. Heat Treatment of Some Copper–Zinc Alloys at the Deformation Heat, Metall (Berlin) (1973), 27,(11), 1069–80 (Abstract Only), 1973.*

*Sokeizai*, vol. 37, No. 5 (1996), pp. 23–31.

* cited by examiner

*Primary Examiner*—Sikyin Ip
(74) *Attorney, Agent, or Firm*—Frishauf, Holtz, Goodman & Chick, P.C.

(57) ABSTRACT

A brass for forging which has an apparent Zn content of 37 to 50 wt % and contains 0.5 to 7 wt % Sn. The brass has a microstructure of at least an α phase and a γ phase at a temperature of 300 to 550° C. and has crystal grain sizes which are made fine. A process for preparing brass involving making the crystal grain size of brass material fine and plastic working the brass material at 300 to 550° C.

14 Claims, 21 Drawing Sheets

(9 of 21 Drawing Sheet(s) Filed in Color)

Fig. 1

Chemical component of material to be tested (wt%)

| Material | Cu | Sn | Pb | Fe | Zn |
|---|---|---|---|---|---|
| Developed material 1 | 59.9 | 1.47 | 1.80 | 0.02 | Remainder (36.8) |
| Developed material 2 | 58.3 | 1.87 | 1.91 | 0 | Remainder (37.9) |
| Developed material 3 | 58.7 | 2.30 | 2.26 | 0 | Remainder (36.7) |
| Conventional material (C3771) | 59.0 | 0.25 | 1.54 | 0.18 | Remainder (39.0) |

Fig. 2

Sample preparation condition

| Material | Forged ingot size | Extrusion machine | Extrusion tempera-ture (°C) | Sectional surface decreasing ratio (R.A.) | Sample size |
|---|---|---|---|---|---|
| Developed material 1 | ϕ180 | 1650 tons Direct extrusion machine | 580 | 97.2% | ϕ30 |
| Developed material 2 | | | 550 | | |
| Developed material 3 | | | 530 | | |
| Conventional material | ϕ250 | 3200 tons Direct extrusion machine | 700 | 98.6% | ϕ30 |

Fig. 3
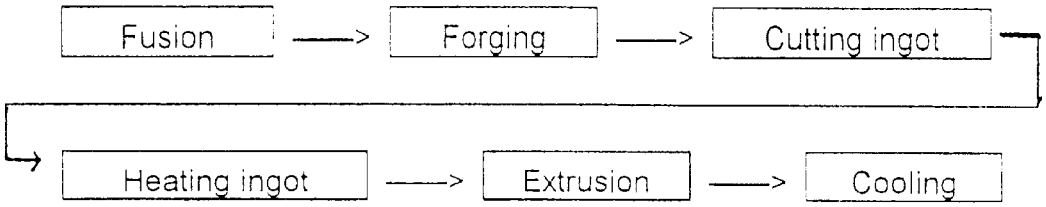
Material to be tested preparation flow
Fig. 4
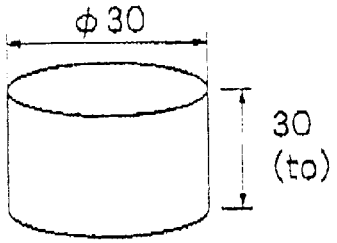
Shape of Upsetting test piece
Fig. 5
Upsetting test conditions
| Temperature (°C) | Temperature raising time (min) | Maintaining time (min) | Strain rate ($sec^{-1}$) |
|---|---|---|---|
| 500 to 700 | 25 | 5 | 4.7 |

Fig. 6
Photograph of plan view
Conventional material
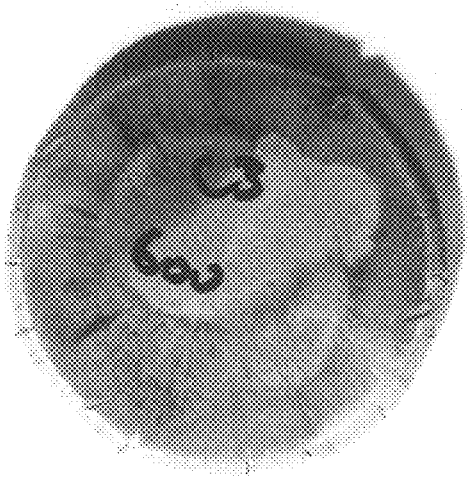
Developed material 2
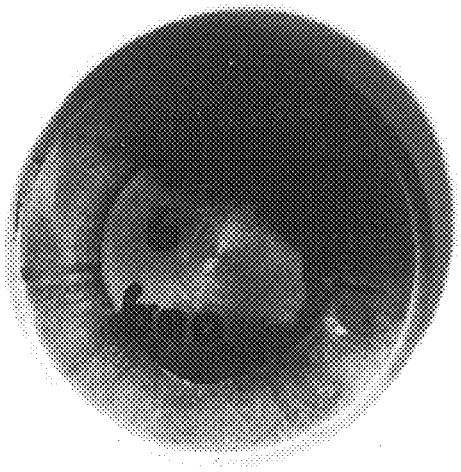

Fig. 7
Photograph of side view
Conventional material
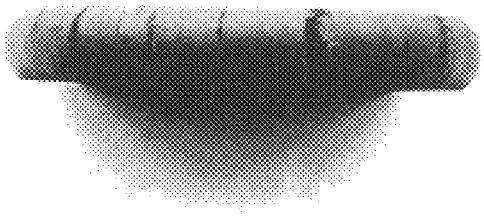
Developed material 2
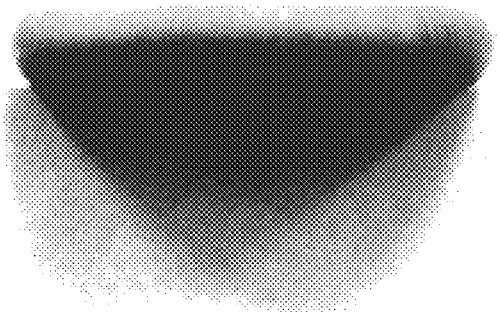

Fig. 8

Upsetting test results

| | | Developed material 1 | Developed material 2 | Developed material 3 | Conventional material (C3771) |
|---|---|---|---|---|---|
| Crystal grain size (μ) | | about 10 μm | about 10 μm | about 9 μm | about 15 μm |
| Tempera-ture | Fractional reduction in upsetting height | | | | |
| 700 °C | 80% | X | X | O | Δ |
| | 70% | Δ | O | O | O |
| | 60% | O | O | O | O |
| | 50% | O | O | O | O |
| 650 °C | 80% | X | O | O | X |
| | 70% | X | O | O | X |
| | 60% | X | O | O | Δ |
| | 50% | O | O | O | O |
| 600 °C | 80% | X | | | |
| | 70% | X | O | Δ | X |
| | 60% | X | O | O | X |
| | 50% | X | O | O | O |
| | 40% | O | O | O | O |
| 550 °C | 80% | | X | X | |
| | 70% | | Δ | X | X |
| | 60% | X | O | X | X |
| | 50% | X | O | O | X |
| | 40% | O | O | O | O |
| 500 °C | 50% | X | X | X | X |
| | 40% | X | O | X | O |
| | 30% | X | O | X | O |
| | 20% | O | O | O | O |

O: No crack, Δ: Slightly cracked, X: Cracked

Fig. 9
Critical fractional reduction in upsetting height of the conventional material
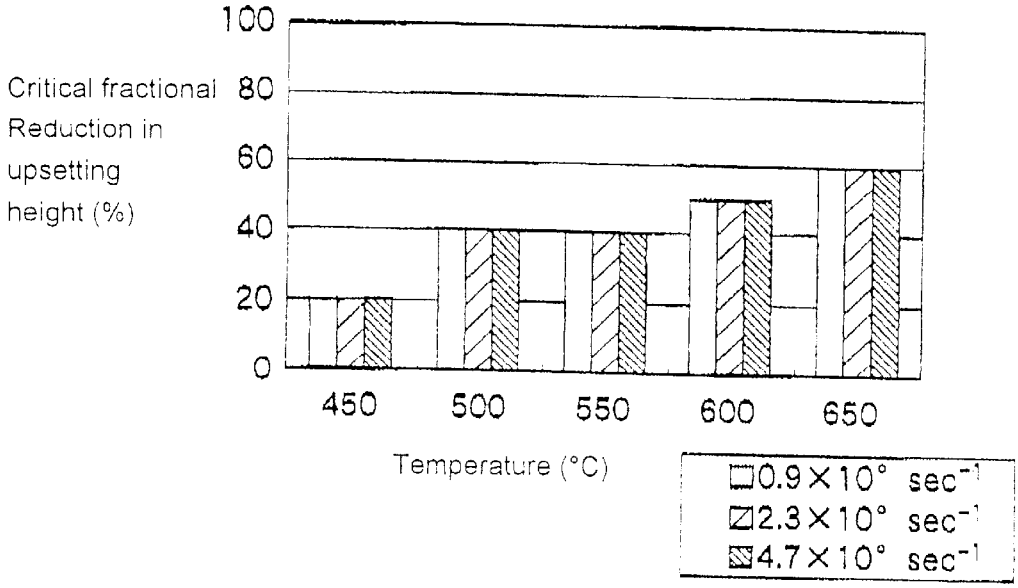
Critical fractional reduction in upsetting height of the developed material 2
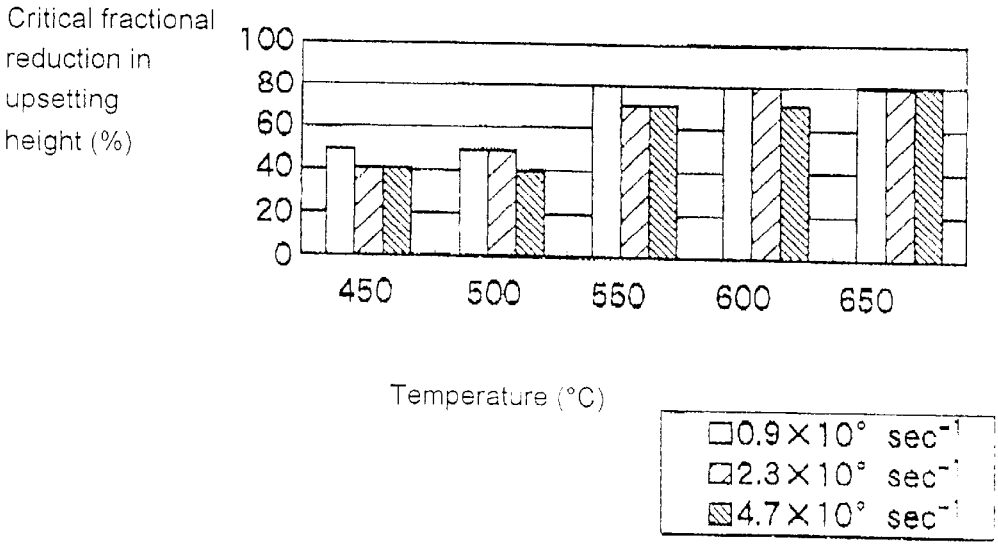

Shape of high temperature tensile test piece

High temperature tensile test conditions

| Temperature (°C) | Temperature raising time (min) | Maintaining time (min) | Initial strain rate ($sec^{-1}$) |
|---|---|---|---|
| 400 to 650 | 10 | 5 | $8.3 \times 10^{-4}$, $10^{-3}$, $10^{-2}$ |

High temperature tensile test~Relationship between Temperature and Elongation

Temperature and Deformation resistance : $\dot{\varepsilon}=8.3\times10^{-4}$

Stress-Strain Curve Figure : $\dot{\varepsilon}=8.3\times10^{-4}$

Fig.15
450°C
Conventional material
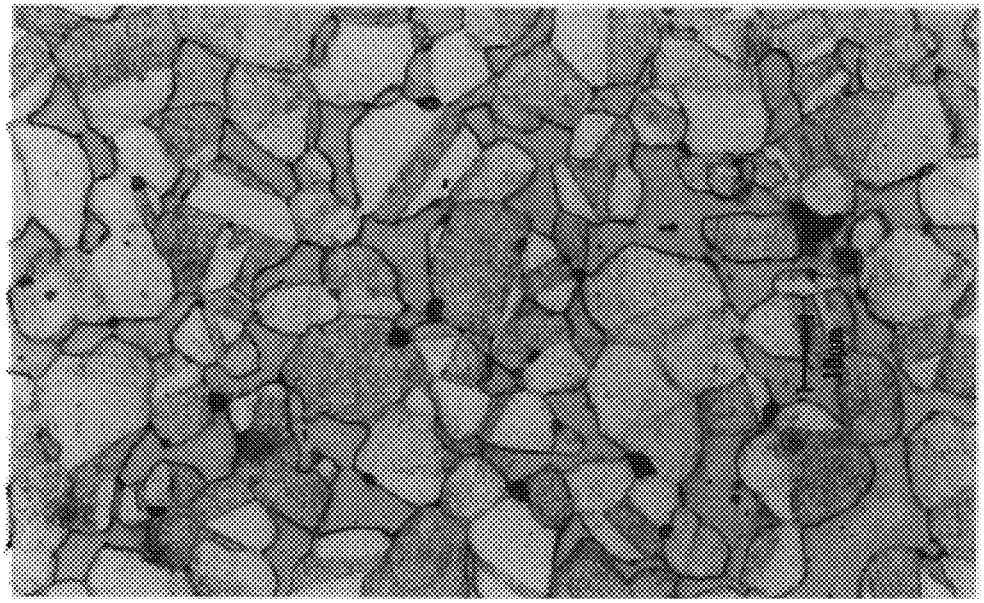
Developed material
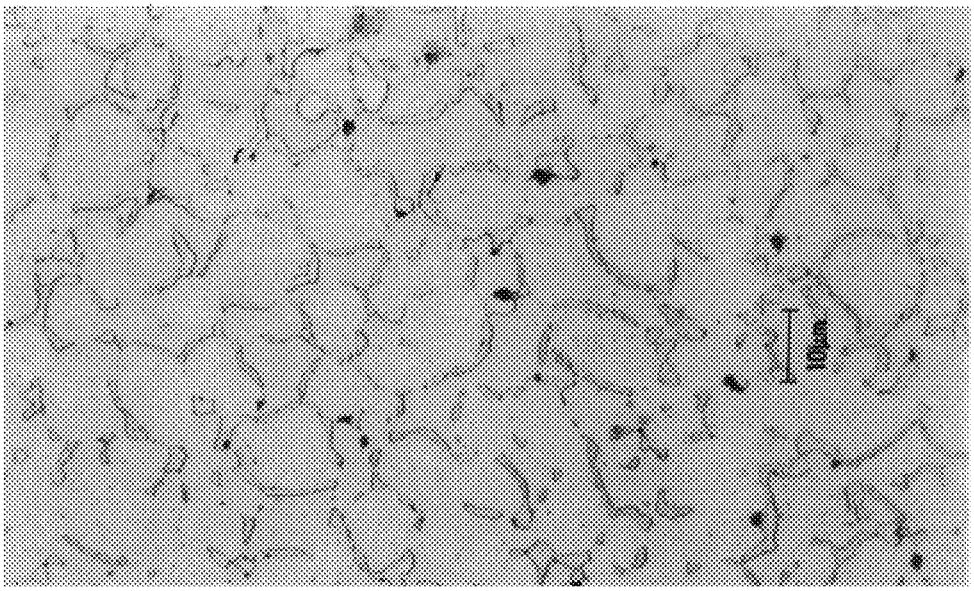

Fig. 16
550°C
Conventional material
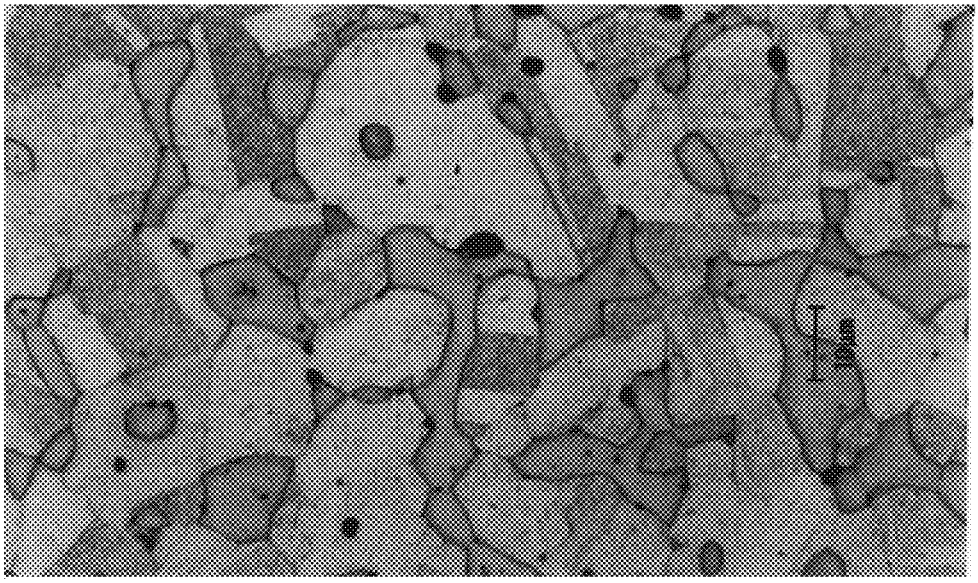
Developed material
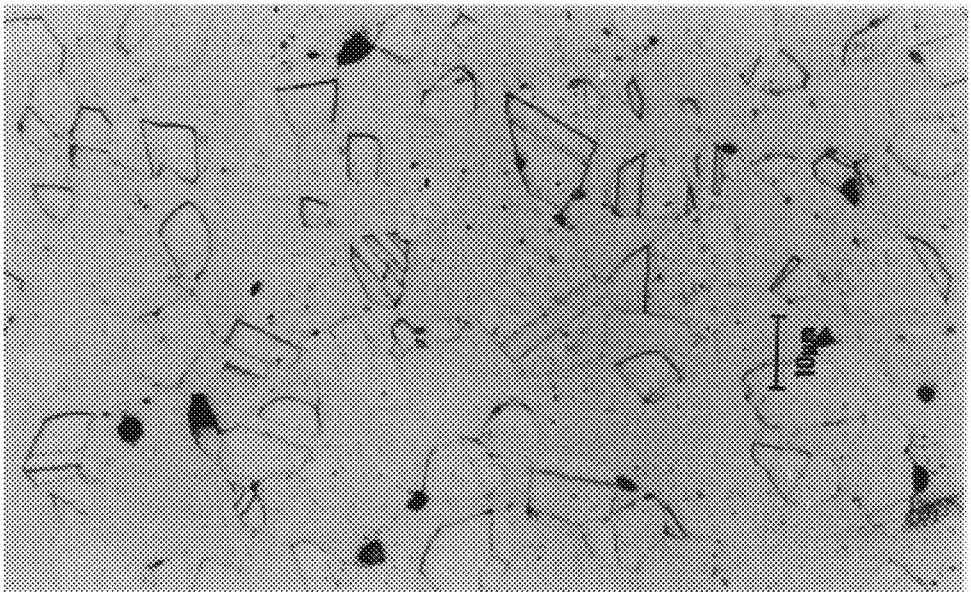

Fig.17
650°C
Conventional material
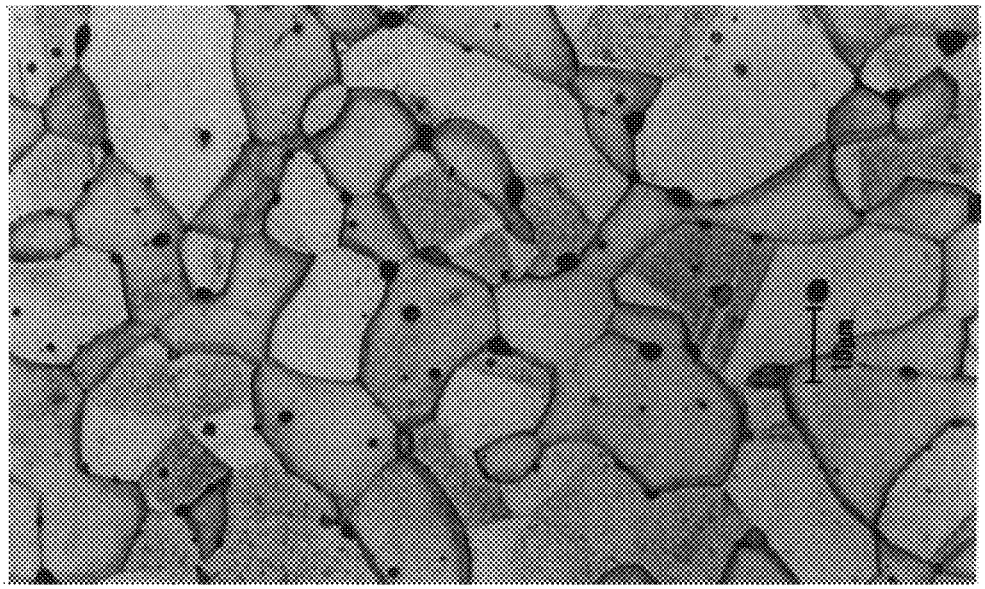
Developed material
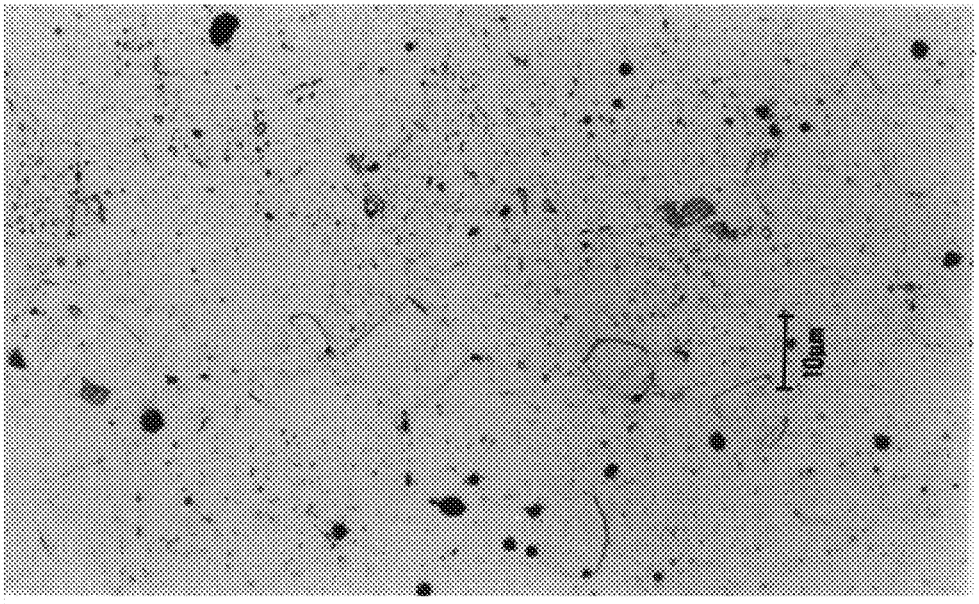

Fig.18
700°C
Conventional material
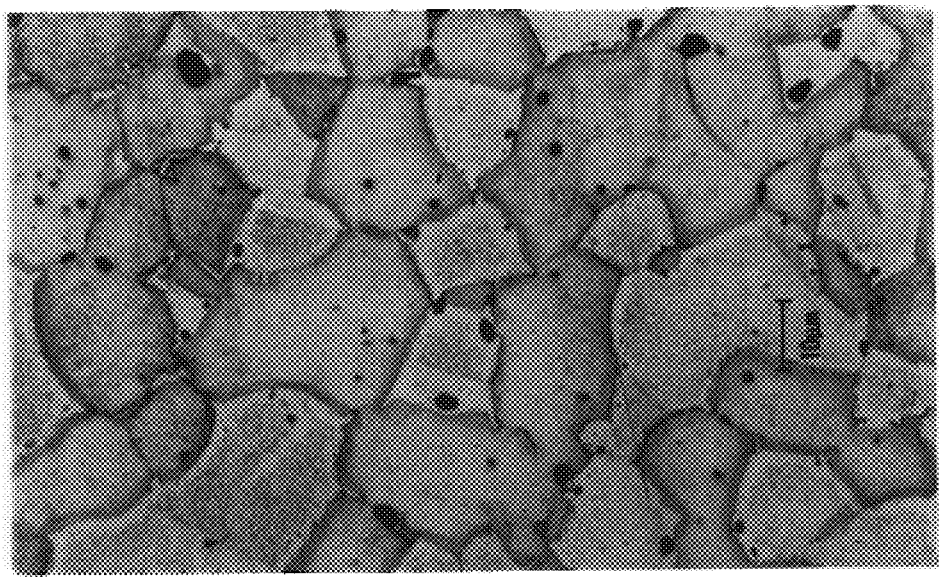
Developed material
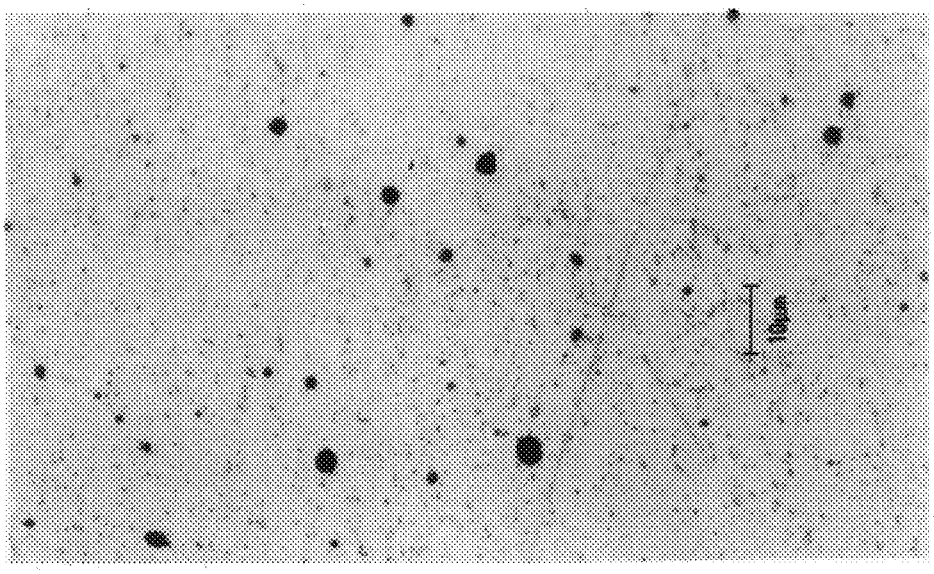

Fig. 19

Temperature and Phase ratio Crystal grain size

| Temperature (°C) | Developed material 2 | | Conventional material | |
|---|---|---|---|---|
| | α/β/γ (%) | Crystal grain size (μm) | α/β/γ (%) | Crystal grain size (μm) |
| 450 | 59/26/15 | 8 ~ 13 | 78/22/0 | 10 ~ 15 |
| 500 | 46/54/0 | 8 ~ 13 | 79/24/0 | 10 ~ 15 |
| 550 | 41/59/0 | 8 ~ 13 | 74/26/0 | 13 ~ 17 |
| 600 | 31/69/0 | 8 ~ 13 | 66/34/0 | 13 ~ 17 |
| 650 | 10/90/0 | — | 54/46/0 | 15 ~ 20 |

Fig. 20

| | Composition (%) | | | |
|---|---|---|---|---|
| | Cu | Sn | Pb | Apparent Zn amount |
| Developed material 2 | 58 | 1.9 | 1.9 | 43.9 |
| Developed material 4 | 58 | 2.5 | 2.0 | 44.5 |
| Developed material 5 | 56 | 3.5 | 2.0 | 47.5 |
| Developed material 6 | 58 | 2.5 | 2.0 | 44.5 |
| Developed material 7 | 58 | 2.5 | 2.0 | 44.5 |
| Comparative material | 59 | 0.3 | 1.5 | 41.3 |

Fig. 21

Preparation method of bar material

| | Extrusion temperature (°C) | Cooling | Heat treatment | Spheroidal treatment |
|---|---|---|---|---|
| Developed material 2 | 550 | Air cooling | — | — |
| Developed material 4 | 550 | Water cooling (15°C/sec) | — | — |
| Developed material 5 | 550 | Air cooling | — | — |
| Developed material 6 | 550 | Air cooling | After heating to β single phase (700°C), rapidly cooling to 450°C (10°C/sec), then air cooled | — |
| Developed material 7 | 550 | Air cooling | After heating to β single phase (700°C), rapidly cooling to 450°C (10°C/sec), then air cooled | Maintained at 450°C for 2 hours, then air cooled |
| Comparative material | 700 | Air cooling | — | — |

Fig. 22

| | Critical fractional reduction in upsetting height (%)* | | | |
|---|---|---|---|---|
| | 450°C | 400°C | 350°C | 300°C |
| Developed material 2 | 40 | — | — | — |
| Developed material 4 | 60 | — | — | — |
| Developed material 5 | 80 | 60 | 40 | 40 |
| Developed material 6 | 60 | — | — | — |
| Developed material 7 | 70 | — | — | — |
| Comparative material | 20 | — | — | — |

* 40% or more is passing, — is not measured

Fig. 23

| | Microstructure at bar material | | | Microstructure at 450°C | | |
|---|---|---|---|---|---|---|
| | Phase ratio (%) $\alpha/\beta/\gamma$ | $\alpha$ grain size (μm) | $\gamma$ short axis grain diameter (μm) | Phase ratio (%) $\alpha/\beta/\gamma$ | $\alpha$ grain size (μm) | $\gamma$ short axis grain diameter (μm) |
| Developed material 2 | 59/26/15 | 13 | 3 | 59/26/15 | 13 | 3 |
| Developed material 4 | 30/70/ 0 | 10 | None | 60/20/20 | 10 | 3 |
| Developed material 5 | 40/30/30 | Short axis 3 | 5 | 40/30/30 | Short axis 3 | 5 |
| Developed material 6 | 65/ 5/30 | Short axis 3 | 3 | 65/ 5/30 | Short axis 3 | 3 |
| Developed material 7 | 68/ 0/32 | 5 | 3 | 68/ 0/32 | 5 | 3 |
| Comparative material | 78/22/ 0 | 15 | None | 78/22/ 0 | 15 | — |

Fig.24
Photograph of microstructure at 450℃
Developed material 2
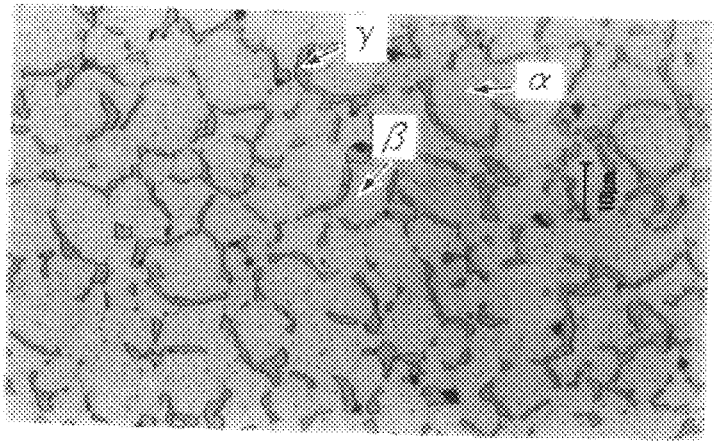
Developed material 4
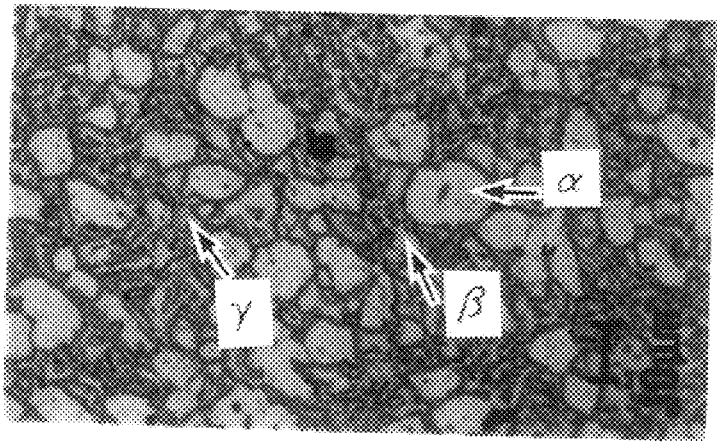
Developed material 5
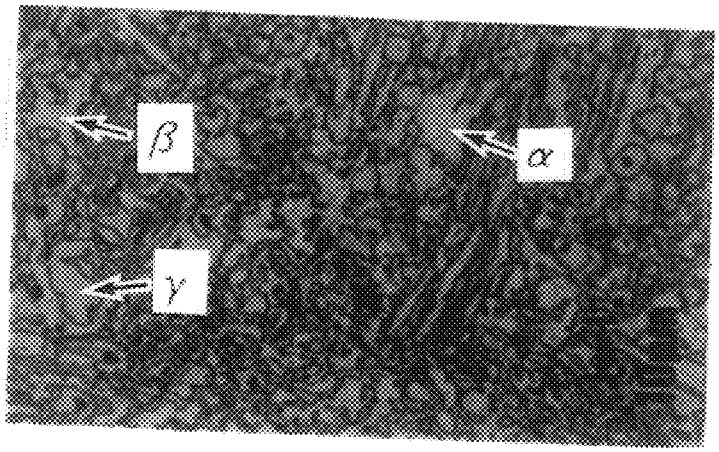

Fig. 25
Photograph of microstructure at 450℃
Developed material 6
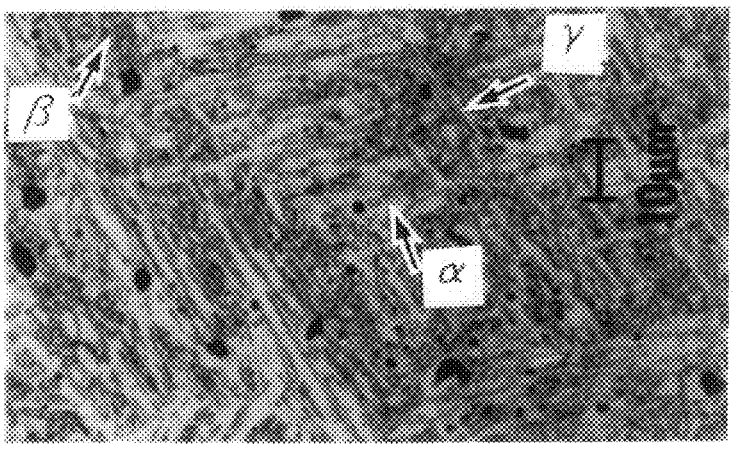
Developed material 7
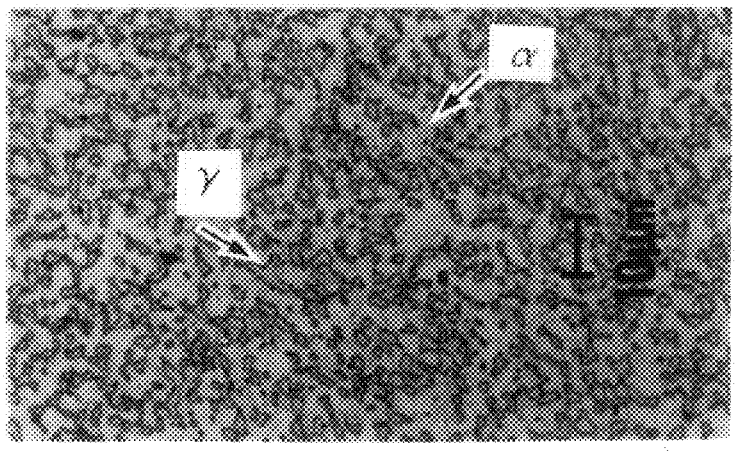
Conventional material
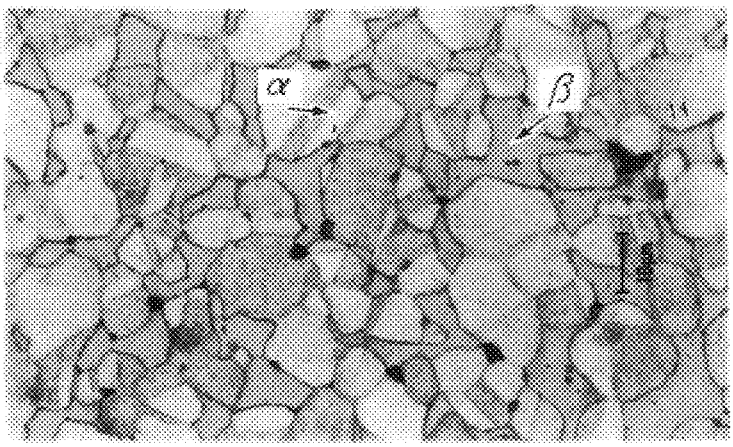

Photograph of microstructure at bar material (room temperature)

Developed material 4

Fig. 27

| | Strength (0.2% endurance) *1 | Corrosion resistance (Dezincing corrosion property) *2 | Erosion corrosion resistance *3 | Stress corrosion-resistant cracking property *4 |
|---|---|---|---|---|
| Developed material 2 | ○ | ○ | ○ | ○ |
| Developed material 4 | ○ | ○ | ○ | ○ |
| Developed material 5 | ○ | ○ | ○ | ○ |
| Developed material 6 | ○ | ○ | ○ | ○ |
| Developed material 7 | ○ | ○ | ○ | ○ |
| Comparative material | X | X | X | X |

*1: 250N/mm$^2$ or more was ○, less than 250N/mm$^2$ was made X.

*2: According to the dezinking corrosion test by the Japan Brass Makers Association Standard (JBMA T-303), when the dezinking penetration depth direction was parallel to the working direction, the maximum dezinking penetration depth of 100 μm or less was made ○, when the dezinking penetration depth direction was perpendicular to the working direction, the maximum penetration depth of 70 μm or less is made ○, and those which are not satisfied these standard was made X.

*3: Tightening torque causing no leak after lapse of 1500 hours of 0.8N·m or more was made X, less than the value was made ○.

*4: While adding a load, after 24 hours, the maximum stress at which no crack was caused of 180N/mm2 or more was made ○, and less than the value was made X.

METAL MATERIAL, BRASS AND METHOD FOR MANUFACTURING THE SAME

1. TECHNICAL FIELD

This invention relates to a metal material, mainly to a copper-zinc alloy, i.e., brass, and processes for preparing the same, but the principle of the present invention to be applied is not limited only to brass.

2. BACKGROUND ART

Brass is generally excellent in machinability, good in corrosion resistance and easy in plastic working so that it has been used in an extremely wide field. Among these, a two-phase alloy of α+β show a large ductility in a hot region (650 to 750° C.), and a modification resistance thereof belongs to the lowest group among the metal materials provided for forging.

However, in the characteristics inherently possessed by the material, it cannot be said that research and development of the material itself have been earnestly studied whereas it has an extremely old history. Recently, only a report about ultra-plasticity at brittleness temperature region of an α-type brass has been found. [Tuyoshi Muto et. al.: Nippon Kinzoku Gakkai-shi, 59 (1995), 28]

The present invention has been done in view of the above-mentioned circumstances, and an object thereof is to provide a metal material, brass and a preparation thereof improved in hot working property.

Also, another object of the present invention is to improve hot working property in a plastic working method of a brass material which is representative as metal materials.

Also, another object of the present invention is to provide brass improved in forging property at a low temperature region of 450° C. or less and a process for preparing the same, and a plastic working method of a brass material.

3. DISCLOSURE OF THE INVENTION

A metal material according to the first embodiment of the present invention is a metal material having a microstructure which is formed by dispersing strain by deformation when an external force is received, and said strain energy by the above-mentioned deformation becomes an energy source of recrystallization of said metal microstructure, characterized in that said microstructure contains the first to the third crystals or phases different in hardness. Thus, in the metal material, as compared with microstructure with two-phases, an amount of an interface between different phases increases so that slipping at the interface between different phases effectively acts. According to this, strain is not locally concentrated but dispersed so that a large amount of strain energy is applied to an energy source for recrystallization whereby high hot ductility can be obtained.

It is suitably desired that the above-mentioned first to third crystals are sufficiently made fine so as to disperse the strain caused at the first crystal which is the softest crystal by slipping at the interface between different phases when an external force is applied thereto. When such a constitution is employed, strain can be easily dispersed in cooperation with the slipping at the interface between different phases.

Brass according to the second embodiment of the present invention comprises an apparent Zn content of 37 to 46 wt % and contains Sn of 1.7 to 2.2 wt %. That is, by firstly making the apparent Zn content 37 to 46 wt %, area ratios of β and γ phases at the recrystallization temperature region can be ensured with certain extents. Here, when the Zn content alone is increased, whereas the β and γ phases can be ensured, an α phase cannot be ensured.

Thus, in the brass according to the second embodiment, by adding Sn which is an element having a large Zn equivalent, while ensuring the β and γ phases at the recrystallization temperature region, the α phase is also ensured sufficiently whereby an interface slipping between the different phases according to the three phases effectively acts. And it is preferred that the Sn amount is regulated to in the range of 1.7 to 2.2 wt %.

Here, the term "an apparent Zn content" is used in the meaning of "$\{(B+txQ)/(A+B+txQ)\}\times 100$" wherein A is a Cu content [wt %], B is a Zn content [wt %], t is a Zn equivalent of the third element (e.g., Sn), and Q is a content of the third element [wt %].

Brass according to the third embodiment of the present invention is brass as a material for effecting plastic working which comprises an apparent Zn content of 37 to 50 wt %, and contains Sn of 1.5 to 7 wt %. Also, more preferably, it is the brass as a material for effecting plastic working comprising an apparent Zn content of 45 to 50 wt %, and containing Sn of 1.5 to 7 wt %.

Brass according to the fourth embodiment of the present invention is brass as a material for effecting plastic working which comprises an apparent Zn content of 37 to 50 wt %, and contains Sn of 3.5 to 7 wt %.

Brass according to the fifth embodiment of the present invention comprises satisfying all the requirements that the microstructure when it is plastic deformed by receiving an external force is a three-phase of α+β+γ, an area ratio of the α phase is 44 to 65%, an area ratio of the β phase is 10 to 55%, an area ratio of the γ phase is 1 to 25%, average crystal grain sizes of the α, β and γ phases are 15 μm or less, preferably 10 μm or less, and the above α and γ phases are present in dispersed states.

Here, when it is a two-phase of α+β, external force-absorption by deformation does not effectively act if the area ratio of the β phase becomes lower than 30%. However, in the present invention, when the area ratio of the β phase is lower than 30%, it is defined to be necessarily a three-phase of the α, β and γ phases. Thus, in this case, slipping at the interface between the different phases effectively acts to realize high ductility.

On the other hand, when the area ratio of the β phase exceeds 80%, growth and coarsening of crystal grains occur whereby ductility is lowered. In the temperature region coexisting the α, β and γ phases as in the present invention, the area ratio of the β phase does not become to such a large value. Also, when the area ratio of the γ phase exceeds 25%, brittleness of the γ phase becomes dominant whereby ductility is lowered. If the area ratio of the α phase exceeds 65%, optimum ratios of the β and γ phases cannot be difficultly ensured.

Moreover, the reason why the average crystal grain sizes of the α, β and γ phases are made 15 μm or less, preferably 10 μm or less, and the above α and γ phases are present by dispersing is not to concentrated locally but to disperse the strain generated at the β phase Brass according to the sixth embodiment of the present invention comprises satisfying all the requirements that the brass has a microstructure of α+β+γ at the recrystallization temperature region, an area ratio of the α phase at the recrystallization temperature region is 44 to 65%, an area ratio of the β phase is 10 to 55%, an area ratio of the γ phase is 1 to 25%, average crystal grain sizes of the α, β and γ phases are 15 μm or less, preferably 10 μm or less, and the above α and γ phases are present in dispersed states.

Brass according to the seventh embodiment of the present invention comprises satisfying all the requirements that the brass has a microstructure of α+β+γ at the temperature region of 300 to 550° C., preferably 400 to 550° C., an area ratio of the α phase at the temperature region is 44 to 65%, an area ratio-of the β phase is 10 to 55%, an area ratio of the γ phase is 1 to 25%, average crystal grain sizes of the α, β and γ phases are 15 μm or less, preferably 10 μm or less, and the above α and γ phases are present in dispersed states.

The brass according to the fifth embodiment of the present invention is brass as a material for effecting plastic working which comprises having at least the γ phase microstructure.

Also, in the brass according to the eighth embodiment of the present invention, an area ratio of the above-mentioned γ phase is preferably 1 to 50 wt %. Also, an average crystal grain diameter of the short axis of the above-mentioned γ phase is preferably 15 μm or less. Also, an average crystal grain diameter of the short axis of the above-mentioned γ phase is more preferably 5 μm or less.

Also, in the brass according to the eighth embodiment of the present invention, an average crystal grain diameter of the short axis of the whole crystal is preferably 15 μm or less. Also, the crystal grain of the above-mentioned γ phase is preferably spheroidal. According to this, forging property of said brass can be improved.

Brass according to the ninth embodiment of the present invention is brass as a material for effecting plastic working which comprises having microstructure of at least a β phase and a γ phase, an area ratio of the β phase is 25 to 45 wt %, and an area ratio of the γ phase is 25 to 45 wt %.

Brass according to the tenth embodiment of the present invention is brass as a material for effecting plastic working which comprises having microstructure of at least an α phase and a β phase, an area ratio of the α phase is 30 to 75 wt %, and an area ratio of the β phase is 5 to 55 wt %.

A process for preparing brass according to the eleventh embodiment of the present invention is a process for preparing the brass having an apparent Zn content of 37 to 46 wt % and containing 1.7 to 2.2 wt % of Sn, which comprises having a step of subjecting to hot extrusion under the conditions of a temperature at the time of extrusion of 300 to 650° C., preferably in the range of 530 to 580° C., and a reduction of area at the time of extrusion of 90% or more, preferably 95% or more. By applying the step, crystal grains of the α, β and γ phases at the recrystallization temperature region can be made fine whereby high hot ductility can be realized.

A process for preparing brass according to the twelfth embodiment of the present invention is a process for preparing the brass having a composition of depositing a γ phase at a predetermined temperature and as a material for effecting plastic working, which comprises having a step of making the crystal grain size fine. This step may be a step of making crystal grain size fine by recrystallization at the time of extrusion. It is preferred that the temperature at the time of extrusion is 300 to 650° C., and the brass comprises an apparent Zn content of 37 to 50 wt % and contains 0.5 to 7 wt % of Sn. Also, the above step may be a step of recrystallizing at annealing after cold working.

A process for preparing brass according to the thirteenth embodiment of the present invention is a process for preparing the brass having a composition of depositing a γ phase at a predetermined temperature and as a material for effecting plastic working, which comprises having a step of subjecting to extrusion for making the crystal grain size fine, and a step of cooling the extruded brass at a rate of 5° C./sec or more. According to this cooling rate, recoasening of crystals once refined can be prevented as little as possible.

Also, in the process for preparing the brass according to the twelfth embodiment of the present invention, the above-mentioned step may be a step of cooling after heating the above-mentioned brass, and during the cooling, a different phase is deposited in the crystal grain to make the crystal grain size fine. This different phase is preferably a γ phase. Also, the γ phase is preferably deposited in a β phase grain. Also, the cooling rate of the above-mentioned brass is preferably so controlled that the above γ phase is inhibited from depositing at a grain boundary.

Also, in the process for preparing the brass according to the twelfth embodiment of the present invention, the above brass has an apparent Zn content of 37 to 50 wt % and contains 0.5 to 7 wt % of Sn. Also, the composition of the brass is desirably so controlled that the γ phase is inhibited from depositing at a grain boundary.

Also, in the step of cooling the above-mentioned brass after heating in the process for preparing the brass according to the twelfth embodiment of the present invention, it is preferred that, after heating said brass to 650 to 750° C. or a temperature region at which the β phase deposits 50 to 100%, a temperature of said brass is lowered 100° C. or more at a cooling rate of 10° C./sec or more to cool the brass up to 450° C. or lower. The reason why the temperature is lowered 100° C. or more is that if it is a temperature lowering of less than 100° C., there is a fear that an area ratio of the γ phase cannot sufficiently be ensured.

In the process for preparing the brass according to the twelfth embodiment of the present invention, the above-mentioned brass desirably has an apparent Zn content of 45 to 50 wt % and contains 0.5 to 7 wt % of Sn, or an apparent Zn content of 37 to 50 wt % and Sn of 3.5 to 7 wt %.

Also, in the step of cooling the above-mentioned brass after heating in the process for preparing the brass according to the twelfth embodiment of the present invention, it is preferred that, after heating said brass to a temperature region of 500 to 650° C., a temperature of said brass is lowered up to 450° C. or lower.

Also, in the step of cooling the above-mentioned brass after heating in the process for preparing the brass according to the twelfth embodiment of the present invention, it is desired to carry out annealing for making the γ phase spheroidal after cooling said brass at a rate of 5° C./sec or more. This annealing is desirably carried out at 450° C. or lower for 30 minutes or longer. Incidentally, it is desirable to previously subject to cold working to the above-mentioned brass. Also, when the brass is cooled at the rate of 5° C./sec or more, if working is carried out during the cooling, the γ phase can be made spheroidal after the cooling.

Also, in the step of cooling the above-mentioned brass after heating in the process for preparing the brass according to the twelfth embodiment of the present invention, said heating may be carried out by subjecting said brass to hot extrusion. The temperature for effecting the extrusion is preferably 300 to 650° C. Also, the above-mentioned brass after subjecting to extrusion is preferably transferred to annealing by maintaining at 450° C. or lower.

A plastic working method of a brass material according to the fourteenth embodiment of the present invention is a plastic working method of a brass material having a composition of depositing a γ phase at a predetermined temperature and subjecting to a step of making crystal grain size fine, which comprises having a step of plastic working said brass by heating to a temperature of causing recrystallization.

Also, in the plastic working method of a brass material according to the fourteenth embodiment of the present invention, the above step is preferably a step of making crystal grain size fine by recrystallization at the time of extrusion. Also, it is preferred that a temperature of the above-mentioned extrusion is 300 to 650° C., an apparent Zn content of the brass is 37 to 50 wt % and it contains 0.5 to 7 wt % of Sn. Also, it is preferred that the above-mentioned step is subjected to annealing after cold working to effect recrystallization.

A plastic working method of a brass material according to the fifteenth embodiment of the present invention is a process for preparing the brass having a composition of depositing a γ phase at a predetermined temperature, which comprises having a step of subjecting to extrusion for making the crystal grain size fine, a step of cooling the extruded brass at a rate of 5° C./sec or more and a step of plastic working said brass by heating to such a temperature to cause recrystallization.

Also, in the plastic working methods of brass materials according to the fourteenth and the fifteenth embodiments of the present invention, the temperature to cause the above-mentioned recrystallization may be 300 to 550° C. Also, in the plastic working methods of brass materials according to the fourteenth and the fifteenth embodiments of the present invention, at the step of subjecting to plastic working, a γ phase is preferably present in the above-mentioned brass.

Also, in the plastic working method of brass material according to the fourteenth embodiment of the present invention, it is preferred that the above-mentioned step is to effect cooling after heating the above-mentioned brass, and the crystal grain size is made fine by depositing the different phase in the crystal grains during the cooling. Also, the above-mentioned different phase is preferably a γ phase. Also, the above-mentioned γ phase is preferably deposited in a β phase grain. Also, the above-mentioned brass preferably comprises an apparent Zn content of 37 to 50 wt % and contains 0.5 to 7 wt % of Sn. Also, the cooling rate of the above-mentioned brass is preferably so controlled that the above-mentioned γ phase is prevented from depositing in the grain boundaries. Also, in the step of cooling the above-mentioned brass after heating, it is preferred to heat said brass to 650 to 750° C. or a temperature region at which 50 to 100% of a β phase is deposited, and then a temperature of said brass is lowered 100° C. or more at a cooling rate of 10° C./sec or more to cool the brass up to 450° C. or lower. Also, it is preferred that the composition of the above-mentioned brass is so adjusted that deposition of the γ phase in the grain boundaries is prevented. Also, the above-mentioned brass is preferably an apparent Zn content of 45to 50 wt %, and contains 0.5 to 7 wt % of Sn. Also, the above-mentioned brass is preferably an apparent Zn content of 37 to 50 wt %, and contains 3.5 to 7 wt % of Sn. Also, in the step of cooling the above-mentioned brass after heating, it is preferred that said brass is heated to a temperature region of 500 to 650° C. and then said brass is cooled to 450° C. or lower. Also, it is preferred that the above-mentioned brass is cooled with a rate of 5° C./sec or more and then annealing for making the γ phase spheroidal is carried out. Also, the above-mentioned annealing is preferably carried out at 450° C. or lower for 30 minutes or longer. Also, the above-mentioned heating is preferably carried out by hot extruding the above-mentioned brass. Also, the temperature for carrying out the above-mentioned. extrusion is preferably 300 to 650° C. Also, it is preferred that the above-mentioned brass subjected to the above-mentioned extrusion is transferred to annealing after maintaining 450° C. or lower.

Brass according to the sixteenth embodiment of the present invention comprises having a high hot ductility causing no damage even when a strain of 160% is given with a strain rate of 0.00083/sec at a recrystallization temperature region.

Brass according to the seventeenth embodiment of the present invention comprises satisfying at least one condition of causing no damage even when a strain of 50% is given with a strain rate of 0.00083/sec at a temperature of 450° C., causing no damage even when a strain of 25% is given with a strain rate of 0.0083 /sec at a temperature of 450° C., or causing no damage even when a strain of 30% is given with a strain rate of 0.083 /sec at a temperature of 450° C. In the conventional brasses, there is no material which satisfy such a ductility at such a low temperature.

A plastic working method of a brass material according to the eighteenth embodiment of the present invention is a plastic working method of a brass material having a composition of depositing a γ phase at a predetermined temperature and a step of making a crystal grain size fine is applied to, which comprises having a step of plastic working the above-mentioned brass by heating to 300 to 550° C. and a fractional reduction in upsetting height of said brass in this step of 40% or more. Also, the above-mentioned step of making fine is preferably a step of making the crystal grain size fine by recrystallization at extrusion. Also, it is preferred that a temperature of the above-mentioned extrusion is 300 to 650° C., an apparent Zn content is 37 to 50 wt %, and Sn is contained in an amount of 0.5 to 7 wt %.

A plastic working method of a brass material according to the nineteenth embodiment of the present invention is a plastic working method of a brass material having a composition of depositing a γ phase at a predetermined temperature, which comprises having a step of extrusion for making a crystal grain size fine, a step of cooling the extruded brass with a rate of 5° C./sec or more, and a step of plastic working the above-mentioned brass by heating to 300 to 550° C., and a fractional reduction in upsetting height of said brass in the step of plastic working of 40% or more.

Also, in the plastic working method of the brass material according to the eighteenth embodiment of the present invention, it is desired that the above-mentioned step is to cool the above-mentioned brass after heating, and the crystal grain size is made fine by depositing a different phase in the crystal grain during the cooling. Also, the above-mentioned different phase is desirably a γ phase. Also, the above-mentioned γ phase is desirably deposited in a β phase grain. Also, the above-mentioned brass desirably comprises an apparent Zn content of 37 to 50 wt % and contains 0.5 to 7 wt % of Sn. Also, the cooling rate of the above-mentioned brass is desirably so controlled that the above-mentioned γ phase is prevented from depositing in the grain boundaries. Also, in the step of cooling the above-mentioned brass after heating, it is desired to heat said brass to 650 to 750° C. or a temperature region at which 50 to 100% of a β phase is deposited, and then a temperature of said brass is lowered 100° C. or more at a cooling rate of 10° C./sec or more to cool the brass up to 450° C. or lower. Also, it is desired that the composition of the above-mentioned brass is so adjusted that deposition of the γ phase in the grain boundaries is prevented. Also, the above-mentioned brass may be an apparent Zn content of 45to 50 wt %, and contain 0.5 to 7 wt % of Sn. Also, the above-mentioned brass may be an apparent Zn content of 37 to 50 wt %, and contain 3.5 to 7 wt % of Sn. Also, in the step of cooling the above-mentioned brass after heating, it is preferred that said brass is heated to a temperature region of 500 to 650° C. and then said brass is cooled to 450° C. or lower. Also, it is preferred that the above-mentioned brass is cooled with a rate of 5° C./sec or more and then annealing for making the γ phase spheroidal is carried out. Also, the above-mentioned annealing is preferably carried out at 450° C. or lower for 30 minutes or longer. Also, the above-mentioned heating is preferably carried out by hot extruding the above-mentioned brass. Also, the temperature for carrying out the above-mentioned extrusion is preferably 300 to 650° C. Also, it is preferred that the above-mentioned brass subjected to the above-mentioned extrusion is transferred to annealing by maintaining 450° C. or lower.

A plastic working method of a brass material according to the twentieth embodiment of the present invention is a plastic working method of a brass material having a composition of depositing a γ phase at a predetermined temperature and a step of making a crystal grain size fine is applied to, which comprises having a step of plastic working the above-mentioned brass by heating to 300 to 550° C. and a fractional reduction in upsetting height of said brass in this step of 70% or more.* It is desired that the composition of the above-mentioned brass is so adjusted that deposition of the γ phase in the grain boundaries is prevented. Also, the above-mentioned brass may be an apparent Zn content of 45 to 50 wt %, and may contain 0.5 to 7 wt % of Sn. Also, the above-mentioned brass may be an apparent Zn content of 37 to 50 wt %, and contain 3.5 to 7 wt % of Sn. Also, the above-mentioned step of making fine is preferably a step of cooling the above-mentioned brass after heating, and said brass is heated to a temperature region of 500 to 650° C. and then said brass is cooled to 450° C. or lower.

A plastic working method of a brass material according to 21st embodiment of the present invention is a plastic working method of a brass material subjecting to plastic working by heating the brass at 300 to 550° C., and a fractional reduction in upsetting height of said brass at plastic working is 40% or more.

A plastic working method of a brass material according to 22nd embodiment of the present invention is a plastic working method of a brass material subjecting to plastic working by heating the brass at 300 to 550° C., and a fractional reduction in upsetting height of said brass at plastic working is 70% or more.

Brass according to the 23rd embodiment of the present invention is a brass having an apparent Zn content of 37 to 50 wt % and containing 0.5 to 7 wt % of Sn, which comprises having a different phase deposited in a crystal grain by cooling said brass after heating, said brass has a γ phase in an amount of 1 to 50 wt %, and an average crystal grain size of a short axis of said γ phase is 5 μm or less.

Brass according to the 24th embodiment of the present invention is a brass having an apparent Zn content of 45 to 50 wt % and containing 0.5 to 7 wt % of Sn, which comprises having a different phase deposited in a crystal grain by cooling said brass after heating, said brass has a β phase in an amount of 25 to 45 wt % and has a γ phase in an amount of 25 to 45 wt %, and an average crystal grain size of a short axis of said γ phase is 10 μm or less.

Brass according to the 25th embodiment of the present invention is a brass having an apparent Zn content of 37 to 50 wt % and containing 3.5 to 7 wt % of Sn, which comprises having a different phase deposited in a crystal grain by cooling said brass after heating, said brass has a β phase in an amount of 25 to 45 wt % and has a γ phase in an amount of 25 to 45 wt %, and an average crystal grain size of a short axis of said γ phase is 10 μm or less.

A plastic working method of a brass material according to the 26th embodiment of the present invention is a plastic working method of a brass material subjecting to plastic working by heating the brass material to 300 to 550° C., which comprises a dynamic recrystallization being caused in said brass material at the time of the above-mentioned plastic working. Also, at the time of the above-mentioned plastic working, it is preferred that a γ phase is present in the above-mentioned brass material.

A process for preparing brass according to the 27th embodiment of the present invention is a process for preparing brass having an apparent Zn content of 37 to 46 wt % and containing 1.7 to 2.2 wt % of Sn, which comprises having a step of hot working said brass in the range of 300 to 550° C. or 400 to 550° C. By subjecting to hot working in this temperature region, an optimum ratio of the α, β and γ phases is ensured at the recrystallization temperature region of said brass so that slipping at the interface during three phases can effectively act. Moreover, by realizing a high hot workability at a low temperature region, it contributes to improve in durability of a working plant. That is, dimensional accuracy at the time of working becomes good and a moldlife becomes long.

A process for preparing brass according to the 28th embodiment of the present invention is a process for preparing brass having an apparent Zn content of 37 to 46 wt % and containing 1.7 to 2.2 wt % of Sn, which comprises having a step of subjecting the above-mentioned brass to hot extrusion under the conditions of a temperature at the extrusion being in the range of 300 to 650° C., and a reduction of area at the extrusion being 90% or more, and a step of hot working said brass in the range of 300 to 550° C. or 400 to 550° C.

A plastic working method of a brass material according to the 29th embodiment of the present invention is a plastic working method of a brass material containing 0.5 to 7 wt % of Sn, which comprises subjecting the plastic working in the range of 300 to 550° C.

A plastic working method of a brass material according to the 30th embodiment of the present invention is a plastic working method of a brass material containing 0.5 to 7 wt % of Sn, which comprises said brass material at the plastic working being a temperature of a temperature region which causes recrystallization during working and a temperature region of 550° C. or lower.

A plastic working method of a brass material according to the 31st embodiment of the present invention is a method of plastic working a brass material at a temperature region of 300° C. or higher or a temperature region of causing recrystallization during working, which comprises a γ phase being present in said brass material at the plastic working. Also, it is preferred that the existing ratio of the above-mentioned γ phase is within the range of 1 to 50 wt %. Also, it is more preferred that the existing ratio of the above-mentioned γ phase is within the range of 25 to 45 wt %, and in the brass material at the above-mentioned plastic working, a β phase is further present and an existing ratio thereof is 25 to 45 wt %.

A plastic working method of a brass material according to the 32nd embodiment of the present invention is a method of plastic working a brass material at a temperature region of 300° C. or higher or a temperature region of causing recrystallization during working, which comprises an α phase and a β phase being present in said brass material at the plastic working, and an existing ratio of said α phase is in the range of 30 to 75 wt % and an existing ratio of said β phase is in the range of 5 to 55 wt %.

Also, in the plastic working method of brass according to the 31st embodiment of the present invention, it is preferred that an average crystal grain diameter of a short axis of the above-mentioned γ phase is 15 μm or less. Also, it is preferred that an average crystal grain diameter of a short axis of the above-mentioned γ phase is 5 μm or less.

Also, in the plastic working method of the brass material according to the 31st embodiment or the 32nd embodiment of the present invention, it is preferred that an average crystal grain diameter of a short axis in the crystal grain of the above-mentioned brass material is 15 μm or less. Also, it is preferred that crystal grain of the above-mentioned γ phase is spheroidal.

A plastic working method of a brass material according to the 33rd embodiment of the present invention is a method of plastic working a brass material which comprises* the γ phase at room temperature, subjecting to the plastic working of said brass material at a temperature of 550° C. or lower.

A plastic working method of a brass material according to the 34th embodiment of the present invention is a method of plastic working a brass material at a temperature region of 300° C. or higher or a temperature region of causing recrystallization during working, which comprises a first step of preparing a brass material, a second step of heating said brass material to the above-mentioned temperature region, and a third step of applying plastic working to said heated brass material, and an area ratio of a γ phase in the above-mentioned third step is increased as compared with that in the above-mentioned first step. Also, an area ratio of the γ phase after completion of the second step is preferably increased than that of the above-mentioned first step. Also, it is preferred to further contain, in the above-mentioned first step, a step of heating the above-mentioned brass material to a temperature region higher than the temperature region at which the γ phase deposits, and then, rapidly cooling said brass material. Also, when the above-mentioned brass material is rapidly cooled, it is preferred that a cooling rate passing through the temperature region at which the above-mentioned γ phase deposits is a cooling rate at which deposition of the γ phase is not saturated, more specifically, it is preferably 5° C./sec or more. Also, when the above-mentioned brass material is rapidly cooled, it is preferred that a cooling rate passing through the temperature region at which the above-mentioned γ phase deposits is a cooling rate at which no γ phase is deposited, more specifically, it is preferably 15° C./sec or more.

A plastic working method of a brass material according to the 35th embodiment of the present invention is a method of plastic working a brass material at a temperature region of 300° C. or higher or a temperature region of causing recrystallization during working, which comprises a first step of preparing a brass material, a second step of heating said brass material to the above-mentioned temperature region, and a third step of applying plastic working to said heated brass material, and said brass material in the above-mentioned third step has a finer average crystal grain size as compared with that in the above-mentioned first step. Also, the brass material after completion of the above-mentioned second step preferably has a finer average crystal grain size as compared with that in the above-mentioned first step. Also, it is preferred to further contain, in the above-mentioned first step, a step of heating the above-mentioned brass material to a temperature region higher than the temperature region at which the γ phase deposits, and then, rapidly cooling said brass material. Also, when the above-mentioned brass material is rapidly cooled, it is preferred that a cooling rate passing through the temperature region at which the above-mentioned γ phase deposits is a cooling rate at which no γ phase is deposited, more specifically, it is preferably 15° C./sec or more. Incidentally, the reason why the above-mentioned cooling rate is made a rate of not depositing the γ phase is that if it is made a rate (5° C./sec or more) at which deposition of the γ phase is not saturated, when the brass material is heated to a working temperature at the above-mentioned second step, the γ phase deposits at the β grain interface so that there is a possibility of not making the crystal grain fine.

4. BRIEF DESCRIPTION OF THE DRAWINGS

The file of this patent contains at least one drawing executed in color. Copies provided to the Patent and Trademark Office upon request and payment of the necessary fee.

FIG. 1 is a drawing showing a chemical component of a material to be tested as one example of brass according to the first embodiment of the present invention.

FIG. 2 is a drawing showing preparation conditions of a material to be tested (sample) in the preparation method of brass according to the first embodiment of the present invention.

FIG. 3 is a drawing showing a preparation flow chart of a material to be tested in the preparation method of brass according to the first embodiment of the present invention.

FIG. 4 is a perspective view showing an upsetting test piece.

FIG. 5 is a drawing showing upsetting test conditions.

FIG. 6 are drawings showing plan view photographs of test pieces of a developed material 2 and a conventional material at 600° C. and a fractional reduction in upsetting height of 70%.

FIG. 7 are drawings showing-side view photographs of test pieces of a developed material 2 and a conventional material.

FIG. 8 is a drawing showing compiled results of upsetting test shown in FIG. 4 and FIG. 5.

FIG. 9 are drawings showing the results of critical fractional reduction in upsetting height of a developed material 2 and a conventional material when a strain rate was changed.

FIG. 15 are drawings showing microstructure photographs of a developed material 2 and a conventional material after heating up to 450° C. and maintaining the temperature, then quenched by cooling with water.

FIG. 16 are drawings showing microstructure photographs of a developed material 2 and a conventional material after heating up to 550° C. and maintaining the temperature, then quenched by cooling with water.

FIG. 17 are drawings showing microstructure photographs of a developed material 2 and a conventional material after heating up to 650° C. and maintaining the temperature, then quenched by cooling with water.

FIG. 18 are drawings showing microstructure photographs of a developed material 2 and a conventional material after heating up to 700° C. and maintaining the temperature, then quenched by cooling with water.

FIG. 19 is a drawing showing the phase ratio and the crystal grain diameter at the respective temperature regions of a developed material 2 and a conventional material.

FIG. 20 is a drawing showing a composition of a material to be tested and an apparent Zn content as one example of a brass material according to the second embodiment of the present invention.

FIG. 21 is a drawing showing a process for preparing a bar material comprising a material to be tested.

FIG. 22 is a drawing to compare critical fractional reduction in upsetting heights of the developed materials 2 and 4 to 7 and the comparative material as the results of the above-mentioned upsetting test.

FIG. 23 is a drawing showing phase ratios and crystal grain sizes of the developed materials 2 and 4 to 7 and the comparative material in the state of a bar material (at room temperature), as well as phase ratios and crystal grain sizes at 450° C.

FIG. 24 are drawings showing microstructure photographs when the developed materials 2, 4 and 5 prepared by the preparation method of the bar material shown in FIG. 21 are heated to 450° C. and maintained, and then, quenched by water-cooling.

FIG. 25 are drawings showing microstructure photographs when the developed materials 6 and 7 and the comparative material prepared by the preparation method of the bar material shown in FIG. 21 are heated to 450° C. and maintained, and then, quenched by water-cooling.

FIG. 27 is a drawing showing the results that strength (0.2% endurance), corrosion resistance (dezincing corrosion resistance), erosion corrosion resistance and stress corrosion cracking resistance were tested with respect to the developed materials 2 and 4 to 7 and the comparative material.

5. BEST MODE FOR PRACTICING THE INVENTION

Figures 10, 11:
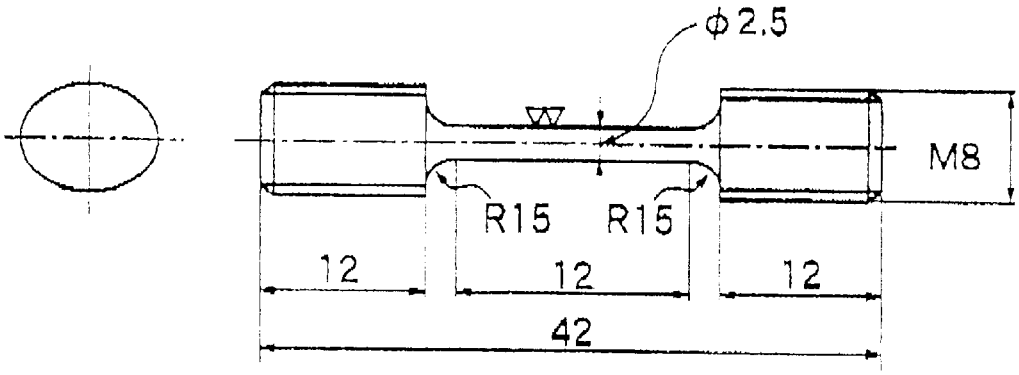
FIG. 10 is a sectional view showing a high temperature tensile test piece.
FIG. 11 is a drawing showing high temperature tensile test conditions.

In the following the first embodiment of the present invention will be explained by referring to the drawing.

[Preparation of a Material to be Tested]

FIG. 1 is a drawing showing a chemical component of a material to be tested as one example of brass according to the first embodiment of the present invention. FIG. 2 is a drawing showing preparation conditions of a material to be tested (sample). FIG. 3 is a drawing showing a preparation flow chart of a material to be tested.

Developed materials 1 to 3 and a conventional material as materials to be tested are prepared according to the preparation flow shown in FIG. 3.

That is, tin and lead are added to a brass scrap to melt the mixed materials. At this time, after adjusting the components to be melted as shown in FIG. 1, casting is carried out to prepare an ingot. The size of the ingot is, as shown in FIG. 2, ϕ 180 mm in the developed materials 1 to 3 and ϕ 250 mm in the conventional material.

Next, after cutting the ingot to a predetermined size, this ingot is heated to an extrusion temperature shown in FIG. 2. Then, as for the developed materials 1 to 3, hot extrusion is carried out at the-extrusion temperature shown in FIG. 2 by using a direct extruder with 1650 tons. Also, as for the conventional material, hot extrusion is carried out at the extrusion temperature of 700° C. shown in FIG. 2 by using a direct extruder with 3200 tons. Thereafter, by cooling the materials to be tested, samples were prepared. The size of the sample is ϕ 30 mm in both of the developed materials and the conventional material.

Among the above-mentioned materials to be tested, the reason that the compositions of the developed materials 1 to 3 are made as shown in FIG. 1 is that the compositions were determined so that a β phase ratio at the hot forging temperature region is increased. Also, tin was added for the purpose of increasing corrosion resistance. Tin has a zinc equivalent of 2 so that it contributes to increase an apparent Zn amount or deposition of a γ phase.

Here, in the developed materials 1 to 3, the reason why the extrusion temperature was lowered from 700° C. of the conventional material to 530 to 580° C. is to make the crystal grains fine.

[Upsetting Test]

Test pieces were cut out from the respective samples of the developed materials 1 to 3 and the conventional material to carry out the upsetting test. FIG. 4 is a perspective view showing an upsetting test piece. This upsetting test piece has a cylindrical shape with ϕ 30 mm and a height of 30 mm.

FIG. 5 is a drawing showing upsetting test conditions. This test is to carry out by increasing the temperature of the test piece to 500–700° C. within 25 minutes, and after maintaining the piece at this temperature for 5 minutes, upsetting is carried out with a strain rate of 4.7/sec. Incidentally, in the present test, a NC controlled oil pressure press with 250 tons was used.

[Experimental Results of Upsetting Test]

FIG. 6 are drawings showing plan view photographs of test pieces of the developed material 2 and the conventional material at 600° C. and a fractional reduction in upsetting height of 70%. FIG. 7 are drawings showing side view photographs of test pieces of a developed material 2 and a conventional material shown in FIG. 6. According to these figures, large crack occurred in the conventional material, but no crack was occurred in the developed material 2.

FIG. 8 is a drawing showing compiled results of upsetting test shown in FIG. 4 and FIG. 5. From this figure, it was found that the developed materials 2 and 3 had good upsetting property as compared with that of the conventional material. Particularly, it could be confirmed that the developed material 2 had excellent hot workability over a wide temperature range from a low temperature to a high temperature of 500 to 700° C. Also, the developed material 3 is excellent in hot workability at a high temperature side of 600 to 700° C. To the contrary, the developed material 1 is high in a copper content and low in a tin content as shown in FIG. 1, so that the upsetting property which is the same or lower than the conventional material can only be obtained.

FIG. 9 are drawings showing the results of critical fractional reduction in upsetting height of the developed material 2 and the conventional material when a strain rate was changed. The developed material 2 showed ductility superior to that of the conventional material over all the temperature region and showed a critical fractional reduction in upsetting height of 50% at a low temperature region of 450° C. Further, whereas the conventional material abruptly lowered in ductility when the temperature became 450° C., the developed material 2 did not lower in ductility even at 450° C.

Also, it was confirmed that the upsetting property of the developed material 2 is improved when the strain rate is made slow. The upsetting test conditions are in a high rate region (practical region) than the tensile test as mentioned hereinbelow, the hot ductility of the developed material 2 was not so lowered even when it was compared with the tensile test result of the strain rate=$8.3\times10^{-2}$ $sec^{-1}$.

[High Temperature Tensile Test]

Test pieces were cut out from the developed material 2 and the conventional material, respectively, and a high temperature tensile test was carried out. FIG. 10 is a sectional view showing a high temperature tensile test piece. This test piece has a shape of a gage points-distance of 12 mm and an outer diameter of $\phi$ 2.5 mm.

FIG. 11 is a drawing showing high temperature tensile test conditions. This test is carried out by raising the temperature of the test piece to 400 to 650° C. within 10 minutes, and after maintaining the temperature for 5 minutes, the tensile test is carried out with an initial strain rate of $8.3\times10^{-4}$ $sec^{-1}$, $8.3\times10^{-3}$ $sec^{-1}$, or $8.3\times10^{-2}$ $sec^{-1}$. Incidentally, the used tensile test machine was a mechanical system one, heating with an electric heater and an atmosphere was in air.

[Results of High Temperature Tensile Test]

Figure 12:
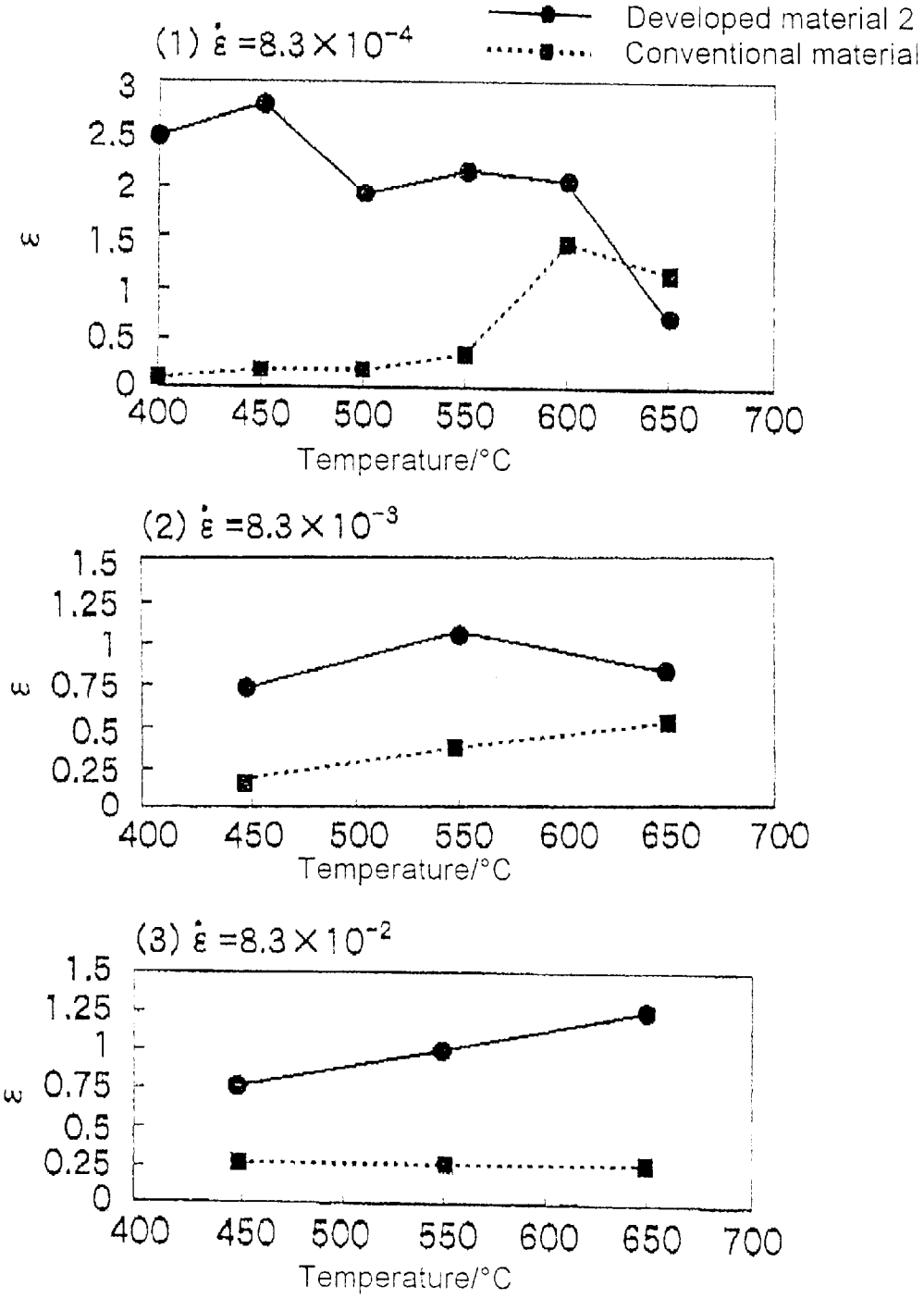
FIG. 12 are drawings showing the relationship between the temperature and the elongation ε in the high temperature tensile test.

With regard to the developed material 2 which showed the most excellent results in the upsetting test, a high temperature tensile test was carried out. Also, the high temperature tensile test was also carried out with regard to the conventional material. FIG. 12 are drawings showing the relationship between the temperature and the elongation $\dot{\epsilon}$ in the high temperature tensile test.

It was confirmed that the developed material 2 was markedly improved in ductility as compared with that of the conventional material over the three kinds of all the strain rate ($\dot{\epsilon}=8.3\times10^{-4}$, $8.3\times10^{-3}$, $8.3\times10^{-2}$) and all the temperature range now tested. Particularly, it was found that it was improved in ductility with a great extent at a lower temperature side of 400 to 450° C. Also, in the low strain rate ($8.3\times10^{-4}$), the developed material 2 showed an elongation of 200% at 500 to 600° C. and near to 300% at 400 to 450° C. Thus, it was found that in the conventional material, the value of ductility was large in the temperature region of a brittle region.

Figure 13:
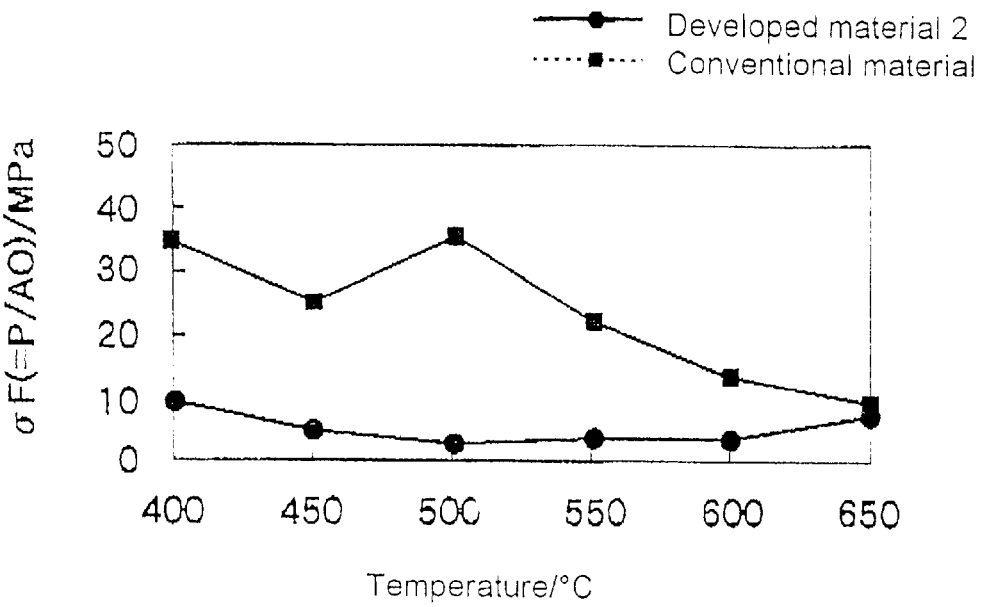
FIG. 13 is a drawing showing the results examined when the low strain rate of ($\epsilon=8.3\times10^{-4}$) as an example of the relationship between the temperature and the strain resistance in the high temperature tensile test.

FIG. 13 is a drawing showing the results examined when the low strain rate of ($\dot{\epsilon}=8.3\times10^{-4}$) as an example of the relationship between the temperature and the strain resistance in the high temperature tensile test. The strain resistance is shown by the maximum apparent stress in the tensile test. The maximum apparent stress means Pmax/A0. Pmax is the maximum load, and A0 is an initial sectional area of the test piece.

It was found that whereas the strain resistance of the conventional material was lowered substantially in proportion to increment of the temperature, temperature dependency of the strain resistance in the developed material 2 was extremely low. Thus, whereas the strain resistances at 650° C. of the conventional material and the developed material 2 were substantially the same, the strain resistance of the developed material 2 at all the temperature region of not more than the above temperature was markedly lowered than that of the conventional material.

Figure 14:
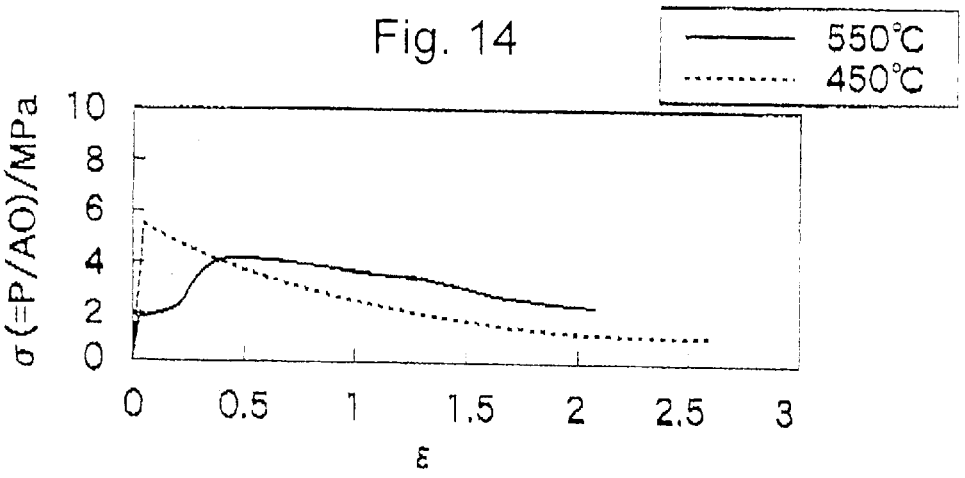
FIG. 14 is a drawing showing a stress-strain line figure in the tensile test of a developed material 2.

FIG. 14 is a drawing showing a stress-strain line figure in the tensile test of the developed material 2. The strain rate at this case is $\dot{\epsilon}=8.3\times10^{-4}$. When referring to FIG. 14, it can be understood that after abruptly increasing the stress immediately after starting tensile, elongation is increased but the stress is decreased, and thereafter elongation is continued with the substantially constant stress.

[Observation of Microstructure]

In order to consider that the developed material 2 shows a large ductility at a wide temperature region, observation of microstructures of the developed material 2 at the respective temperature regions was carried out. The developed material 2 was heated to the respective temperature region and maintained, and quenched by water-cooling. Observation of the structures at the respective temperature regions was carried out as mentioned above. Incidentally, as for the respective materials of the present test, it is confirmed that no change in the structure such as transformation due to quenching occurred.

FIG. 15 are drawings showing microstructure photographs of the developed material 2 and the conventional material after heating up to 450° C. and maintaining the temperature, then quenched by cooling with water. FIG. 16 are drawings showing microstructure photographs of the developed material 2 and the conventional material after heating up to 550° C. and maintaining the temperature, then quenched by cooling with water. FIG. 17 are drawings showing microstructure photographs of the developed material 2 and the conventional material after heating up to 650° C. and maintaining the temperature, then quenched by cooling with water. FIG. 18 are drawings showing microstructure photographs of the developed material 2 and the conventional material after heating up to 700° C. and maintaining the temperature, then quenched by cooling with water.

As shown in FIG. 15, both of the developed material 2 and the conventional material had crystal grain sizes at 450° C. of about 10 $\mu$m or so. Also, as shown in FIG. 15 to FIG. 18, in the developed material 2, no coarsening in crystal size was observed irrespective of increment of the temperature. To the contrary, in the conventional material, accompanying with increment of the temperature, there is shown a tendency of somewhat coarsening. Also, as shown in FIG. 16 and FIG. 17, the developed material 2 at 550° C. or 650° C. was a two-phase mixed structure of "$\alpha+\beta$", but as shown in FIG. 15, the developed material 2 at 450° C. became a three-phase mixed structure of "$\alpha+\beta+\gamma$" by depositing a $\gamma$ phase. The $\gamma$ phase was deposited at the boarder region of the $\alpha$ phase and the $\beta$ phase.

Incidentally, black points appearing in the photographs of FIG. 15 to FIG. 18 are lead incorporated to improve cutting property. According to the report of Hamasaki et al. [Masanao Hamasaki et al.: Nippon Metal Association, Autumn Meeting, Lecture Summary (1994), 103], it is shown that it becomes an inhibiting factor against hot ductility.

FIG. 19 is a drawing showing the phase ratio and the crystal grain diameter at the respective temperature regions of the developed material 2 and the conventional material. The developed material 2 became a three-phase mixed phase at 450° C., at the temperature region of 500° C. or higher, accompanying with increment of the temperature, a ratio of the β phase became large. At 650° C., 10% of the α phase became the state of floating in island shape, and at 700° C., the α phase was disappeared to become the β single phase. On the other hand, in the conventional material, as shown in FIG. 1, it contains much amount of copper and substantially not contains tin so that it became a two-phase mixed structure of "α+β", and the α phase remained 50% or more at 650° C.

[Consideration]

A phase ratio and elongation at the respective temperature regions of the developed material 2 are compared in the case of the low strain rate ($\dot{\epsilon}=8.3\times10^{-4}$). As shown in FIG. 12 and FIG. 19, in the two-phase region of α+β, a temperature region which shows good elongation of 200% or so is 500 to 600° C. In this temperature region, as shown in FIG. 19, the β phase ratio is 50 to 70%. A temperature region at which the β phase ratio became 90% is 650° C., and in this temperature region, ductility is lowered as shown in FIG. 12.

On the other hand, in the conventional material, in the range of 450 to 650° C., it is two phase structure of α+β as shown in FIG. 19. Similarly as in the developed material 2, when a phase ratio and elongation are compared in the case of the low strain rate ($\dot{\epsilon}=8.3\times10^{-4}$), at the temperature region of 400 to 550° C. at which the β phase ratio becomes 20% or so, an amount of the β phase is too little whereby high ductility cannot be obtained as shown in FIG. 12.

From the above matter, it can be considered that improvement in ductility can be obtained when the β phase resides in a constant ratio. This mechanism can be considered as follows.

First, the hardnesses of the a and β phases are the same degree at the neighbor of 350° C., but at the neighbor of 400° C., the β phase rapidly softens to become about a half hardness to that of the α phase and the difference of the hardness between the α and β phases are remarkable. When an external force is applied to in such a state, the β phase has a high ductility as compared with that of the α phase so that the soft β phase grains are easily deformed by the hard α phase grains at the hot temperature region.

When deformation at the hot temperature region is generated by slipping at the interface between different phases of the α phase and the β phase, it can be considered that high ductility is shown by a role of the circulation that recrystallization at the neighbor of the slipping surface is promoted by a strain energy given from the a phase to the β phase, and the given strain state is relaxed and eliminated to restore the initial state before deformation. It can be considered that geometrical conditions which most frequently cause grain boundary slipping at the interface between different phases cause a proper region of the α and β phase ratio.

That is, high ductility can be obtained at a low temperature side than the conventional material by existing the different phases of α (hard) and β (soft) with a proper ratio, utilizing easiness at the interface between different phases [Satoshi Hashimoto, et al.,: Nippon Metal Association Journal, 31 (1992), 116], and further making the crystal grains fine to disperse and uniformize the strain and to heighten dynamic recrystallization rate.

Incidentally, if the β phase ratio becomes too high as 90% or more, as soon as growth and coarsening of the crystal grains occur [Japan Brass Making Association: Basis of Copper and Copper Alloy and Industrial Technology (1994), 541], giving a strain energy from the α phase grains to the β phase grains is not carried out so that the ductility is considered to be lowered.

On the other hand, as shown in the case of $\dot{\epsilon}8.3\times10^{-4}$ in FIG. 12, at the three-phase region of α+β+γ at 450° C. or lower, the ductility is further improved. This can be considered that in addition to an α−β interface due to the α and β phases the hardnesses of which are largely differed, an α−γ interface and β−γ interface due to the presence of the hard γ phase are added so that the interfaces between different phases causing slipping are increased by three-phased crystal grains. Provided that at the present stage, it is unclear about the details of the mechanical characteristics, etc. of the γ phase at the respective temperature regions, so that roles of the respective phases affecting to ductility are not yet clear.

Also, as the other reason of improvement in ductility, it can be considered that the developed material 2 is a material in which the crystal grain size is made fine by about 10 μm (the conventional material is about 15 μm) and the area of the interface between different phases is increased.

On the other hand, as shown in FIG. 12, when the strain rate is increased 10-fold or 100-fold from $8.3\times10^{-4}$ $sec^{-1}$ the maximum elongation decreases to around 100% and a peak of elongation shifts to a high temperature side. This can be considered that when the strain rate becomes fast, a rate of the dynamic recrystallization cannot catch up with it and the maximum elongation decreases, while at the high temperature side at which the rate of the dynamic recrystallization is fast as compared with the low temperature side, decrease in elongation is small. Also, it can be also considered that the core of the deformation transferred from the grain boundary slipping to deformation in grains.

Incidentally, in the conventional material, ductility was abruptly increased at 600° C. This can be considered that the conditions of the deformation in the tensile test become the similar temperature region and strain rate conditions of the developed material 2 whereby the crystal grains are made fine to give improvement in ductility. To confirm the above, the test was stopped after starting of the tensile test and before crack, the test piece was quenched by water-cooling to observe the structure, the crystal grain size was 9 μm.

As described above, in the developed material 2, an excellent hot ductility which is never appeared in the conventional copper-zinc alloy can be obtained by control of the crystal (control of an αβ-phases ratio, making crystal grains fine).

In the developed material 2, tin is added to deposit a γ phase, and the αβγ-phase ratio is controlled along with making crystal grain sizes fine so that high ductility can be obtained at a low temperature, which was not possible in a conventional material.

Accordingly, forging at a low temperature of 600° C. or less can be carried out, and the possibility of effecting near net shape forging which can simultaneously realize high precision, high surface roughness and a complicated shape can be enlarged.

Next, by referring to the drawings, the second embodiment of the present invention is explained.

[Preparation of Material to be Tested]

FIG. 20 is a drawing showing a composition of a material to be tested and an apparent Zn content as one example of a brass material according to the second embodiment of the present invention. FIG. 21 is a drawing showing a process for preparing a bar material comprising a material to be tested.

Rod materials comprising developed materials 2 and 4 to 7 and a comparative material were prepared by the following method as materials to be tested.

First, tin and lead are added to a brass scrap to melt the mixed materials. At this time, after adjusting the components to be melted as shown in FIG. 20, casting is carried out to prepare an ingot. Next, after cutting the ingot to a predetermined size, this ingot is heated to an extrusion temperature shown in FIG. 21. The temperature at this time is 550° C. in the developed materials 2 and 4 to 7, and 700° C. in the conventional material. Then, as for the developed materials 2 and 4 to 7, hot extrusion is carried out at the extrusion temperature of 550° C. by using a direct extruder. According to this extrusion, crystal grain sizes of the developed materials are made fine. This is because crystal grains are recrystallized at the extrusion. Also, as for the conventional material, hot extrusion is carried out at the extrusion temperature of 700° C.

Thereafter, as for the developed material 4, by quenching it with a rate of 15° C./sec by water-cooling, a sample was prepared. Also, as for the developed materials 2 and 5 and the conventional material, samples were prepared by air cooling (5° C./sec). Incidentally, the cooling rate of 5° C./sec is a rate in which the crystal grain size is not coarsened during cooling. (It is a rate while a γ phase is deposited in the developed material, but deposition of the γ phase is not saturated.) The cooling rate of 15° C./sec is a rate of not depositing the γ phase in the developed materials.

Also, as for the developed material 6, after air cooling, it was heated to 700° C. at which the microstructure became a β single phase, thereafter quenching at a rate of 10° C./sec or so by 450° C., and then, air cooling to prepare a sample. Also, as for the developed material 7, after air cooling, it was heated to 700° C. at which the microstructure became a β single phase, thereafter quenching at a rate of 10° C./sec or so by 450° C., next, maintaining at 450° C. for 2 hours to applying a treatment of making spheroidal, and then, air cooling to prepare a sample.

Among the above-mentioned materials to be tested, the reason that the compositions of the developed materials 2 and 4 to 7 are made as shown in FIG. 20 is that the compositions were determined so that a β phase ratio at the hot forging temperature region is increased. Also, tin was added for the purpose of increasing corrosion resistance.

Tin has a zinc equivalent of 2 so that it contributes to increase an apparent Zn amount or deposition of a γ phase.

Also, in the developed materials 2 and 4 to 7, the reason why the extrusion temperature was lowered from 700° C. of the conventional material to 550° C. is to make the crystal grains fine.

Also, in the developed materials 6 and 7, the reason why quenching after heating is to make crystals fine by depositing a different phase in the crystal grains during said cooling. (If it is not quenching, deposition of a different phase occurs at the crystal grain boundary so that the crystals are not made fine.) In this case, a γ phase is deposited in the β phase grains. Incidentally, in the developed material 5, an Sn added amount and an apparent Zn content are large so that deposition of a different phase occurs in the crystal grains to make the crystal fine even when quenching is not carried out after heating.

[Upsetting Test]

Test pieces were cut out from the respective samples of the developed materials 2 and 4 to 7 and the conventional material to carry out the upsetting test.

As for the developed materials 2 and 4 to 7 and the conventional material, each of the test pieces was raised to 450° C. for 25 minutes, and after maintaining the temperature for 5 minutes, upsetting was carried out with a strain rate of 0.9 $sec^{-1}$. Moreover, with regard to the developed material 5, each test piece was raised to 300° C., 350° C., or 400° C., respectively, and after maintaining these temperatures for 5 minutes, upsetting was carried out with a strain rate of 0.9 $sec^{-1}$. Incidentally, in the present test, a NC controlled oil pressure press with 250 tons was used.

Also, when upsetting is carrying out to the developed materials 2 and 4 to 7 as described above, a γ phase is present in said developing material. Also, when the upsetting is carrying out, it can be considered that dynamic recrystallization is caused.

[Experimental Results of Upsetting Test]

FIG. 22 is a drawing to compare critical fractional reduction in upsetting heights (a critical fractional reduction in upsetting height in the upsetting test) of the developed materials 2 and 4 to 7 and the comparative material as the results of the above-mentioned upsetting test. Incidentally, a material having a critical fractional reduction in upsetting height of 40% or more is a preferred sample. The developed materials 2 and 4 to 7 show superior ductilities to that of the conventional material. The developed materials 2 and 4 to 7 subjected to upsetting at 450° C. showed critical upsetting ratios of 40% or more. Particularly, the developed materials 5 and 7 subjected to upsetting at 450° C. showed critical fractional reduction in upsetting heights of 70% or more. Also, as for the developed material 5, it showed a critical fractional reduction in upsetting height of 40% or more even at a low temperature region of 300 to 400° C.

The reason why the fractional reduction in upsetting height is so improved can be considered that grain boundary slipping effectively acts at the time of upsetting by making the crystal grain size of the developed material fine.

Also, in the developed material 5, the reason why it shows an improvement in extremely high forging characteristics that the critical fractional reduction in upsetting height at 450° C. is 80% can be considered that interfaces of different phases of the α phase and the β phase, the α phase and the γ phase, and the β phase and the γ phase each of which is different in hardness with the same degree of ratios of the α phase, the β phase and the γ phase, are dispersed and grain boundary slipping effectively acts with good balance.

[Observation of Microstructure]

In order to consider that the developed materials 2 and 4 to 7 show high critical fractional reduction in upsetting height at a low temperature of 450° C., observation of microstructures of the respective developing materials 2 and 4 to 7 and the comparative material was carried out. Incidentally, with regard to the respective materials of this test, it had been confirmed that no change in the structure such as deformation by quenching occurs.

FIG. 24 are drawings showing microstructure photographs when the developed materials 2, 4 and 5 prepared by the preparation method of the bar material shown in FIG. 21 are heated to 450° C. and maintained, and then, quenched by water-cooling.

As shown in FIG. 24, in the developed material 2 at 450° C., a crystal grain size of the α phase was about 13 μm or so, and a short axis grain size of the γ phase was about 3 μm or so. Also, in the developed material 4, a crystal grain size of the α phase was about 10 μm or so, and a short axis grain size of the γ phase was about 3 μm or so. Also, in the developed material 5, a crystal grain size of the α phase was about 3 μm or so, and a short axis grain size of the γ phase was about 5 μm or so. Also, in the developed material 5, the γ phase is inhibited from depositing at the grain boundary. This is because the composition of the developed material 5 is so adjusted to that shown in FIG. 20. Also, when the γ phase is deposited at the grain boundary, the crystal grain size does not become fine.

FIG. 25 are drawings showing microstructure photographs when the developed materials 6 and 7 and the comparative material prepared by the preparation method of the bar material shown in FIG. 21 are heated to 450° C. and maintained, and then, quenched by water-cooling.

As shown in FIG. 25, in the developed material 6 at 450° C., a crystal grain size of a short axis of the α phase was about 3 μm or so, and a short axis grain size of the γ phase was about 3 μm or so. Also, in the developed material 7, a crystal grain size of a short axis of the α phase was about 5 μm or so, a short axis grain size of the γ phase was about 3 μm or so, and the crystal of the γ phase became spheroidal. Also, in the comparative material, a crystal grain size of the α phase was about 15 μm or so. Also, in the developed materials 6 and 7, the γ phase is prevented from depositing at the grain boundaries. This is because the cooling rate was controlled in the preparation process of the developed materials 6 and 7 as mentioned above.

Figure 26:
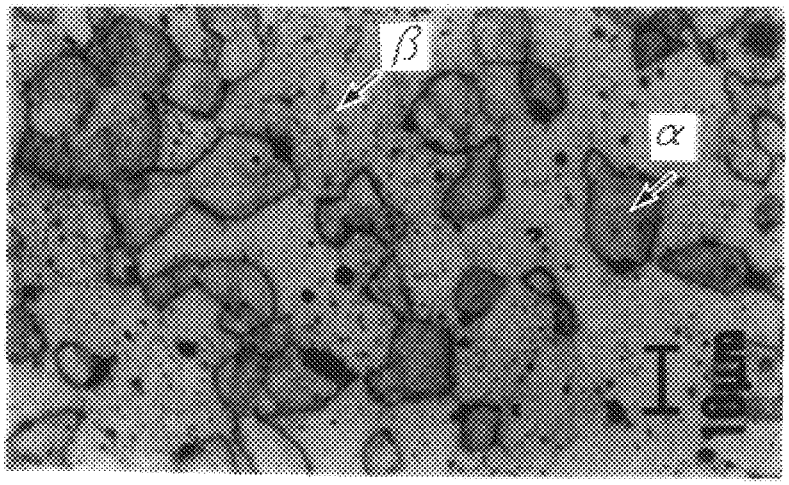
FIG. 26 is a drawing showing microstructure photograph of the developed material 4 prepared by the preparation method of the bar material shown in FIG. 21 at room temperature.

FIG. 26 is a drawing showing microstructure photograph of the developed material 4 prepared by the preparation method of the bar material shown in FIG. 21 at room temperature. In the developed material 4 at room temperature, the crystal grain size of the α phase was about 10 μm.

Also, the microstructure of the developed material 4 shown in FIG. 24 is increased in an area ratio of the γ phase as compared with the microstructure of the developed material 4 shown in FIG. 26. From this fact, when the developed material 4 produced by the preparation method of a bar material shown in FIG. 21 is heated to 450° C., it can be understood that an area ratio of the γ phase is increased as compared with that before the heating (that is, in the state of a rod). Accordingly, it can be said that the area ratio of the γ phase when the upsetting of the developed material 4 is carried out at the temperature of 450° C. as described above is increased as compared with that of the developed material 4 at the room temperature before heating to 450° C.

Also, the microstructure of the developed material 4 shown in FIG. 24 is made finer in the average crystal grain size as compared with the microstructure of the developed material 4 shown in FIG. 26. From this fact, when the developed material 4 produced by the preparation method of a bar material shown in FIG. 21 is heated to 450° C., it can be understood that the average crystal grain size becomes finer as compared with that before the heating (that is, in the state of a rod). Accordingly, as described above, it can be said that the average crystal grain size when the upsetting of the developed material 4 is carried out at the temperature of 450° C. as described above is increased as compared with that of the developed material 4 at the room temperature before heating to 450° C.

As shown in FIG. 24 to FIG. 26, the developed materials 2 and 4 to 7 are small in crystal grain size of the α phase as compared with the comparative material. Also, whereas the comparative material does not have the γ phase, but the developed materials 2 and 4 to 7 have the γ phase.

FIG. 23 is a drawing showing phase ratios and crystal grain sizes of the developed materials 2 and 4 to 7 and the comparative material in the state of a bar material (at room temperature), as well as phase ratios and crystal grain sizes at 450° C. The developed materials 2 and 4 to 7 have at least the α phase and the γ phase at room temperature or 450° C. On the other hand, the comparative material contains a lot of amount of copper and does not substantially contain tin, so that it became a two-phase mixed structure of "α+β".

[Consideration]

As shown in FIG. , 23, whereas the comparative material does not have the γ phase, the developed materials 2 and 4 to 7 have the γ phase at least at 450° C. From the fact, it can be considered that ductility is further improved when the material has the γ phase. That is, as shown in FIG. 22, the critical fractional reduction in upsetting height is superior in the developed materials 4 to 7 to that of the developed material 2 so that it can be considered that the ductility is further improved when the ratio of the γ phase is larger.

As described above, in the developed materials 2 and 4 to 7, excellent hot ductility could be obtained by controlling the crystals (control of the αβγ phases ratio, making the crystal grain size fine) which had never been possessed by the conventional copper-zinc alloy.

Accordingly, forging at a low temperature of 450° C. or less can be carried out, and the possibility of effecting near net shape forging which can simultaneously realize high precision, high surface roughness and a complicated shape can be enlarged.

FIG. 27 is a drawing showing the results that strength (0.2% endurance), corrosion resistance (dezincing corrosion resistance), erosion corrosion resistance and stress corrosion cracking resistance were tested with respect to the developed materials 2 and 4 to 7 and the comparative material.

As for strength (0.2% endurance), 250 N/mm$^2$ or more is made passing "O", and less than 250 N/mm$^2$ is failure "X".

As for corrosion resistance (dezincing corrosion resistance), according to a dezincing corrosion test due to Japan Brass Makers Association Technical Standard (JBMA T-303), when the processing direction is parallel to the processing direction, the maximum dezincing permeation depth of 100 μm or less is made passing "O", and when the processing direction is perpendicular to the processing direction, the maximum dezincing permeation depth of 70 μm or less is made passing "O", and the material which does not satisfy these standard is made failure "X".

As for erosion corrosion resistance, a clamping torque without any leakage after lapse of 1500 hours of 0.8 N·m or more is made failure "X", and less than 0.8 N·m is made passing "O".

As for stress corrosion cracking resistance, in the maximum stress which does not cause any crack after 24 hours while applying a load to the test material, 180 N/mm$^2$ or more is made passing "O", and less than 180 N/mm$^2$ is made failure "X".

According to FIG. 27, the developed materials 2 and 4 to 7 are all passing in all of the tests, but the comparative material was failure in all the tests. From this fact, it could be confirmed that the developed materials 2 and 4 to 7 were not only excellent in forging characteristics but also excellent in strength, corrosion resistance, erosion corrosion resistance and stress corrosion cracking resistance.

The present invention is not limited to the above-mentioned embodiments, and can be practiced by variously changing. For example, the present invention can be applied to the other metal materials other than the above-mentioned metal materials so long as it is a metal material having a microstructure which deforms when an external force is applied thereto and causes by dispersing a strain, and the strain energy by the above-mentioned deformation becomes an energy source of recrystallization of said metal crystal, and said microstructure contains the first to the third crystals or phases different in hardness.

6. UTILIZABILITY IN INDUSTRY

The metal material, brass and processes for preparation thereof and a plastic working method of a brass material of the present invention can be applied not only to the uses to which brass has conventionally been used such as water-contacting parts such as valve, water tap, etc., hygiene china metal fittings, various kinds of joints, pipes, gas tools, building materials such as a door, a knob, etc., home electric goods, etc., but also a product in which other materials other than brass has been used by the reasons of surface roughness, corrosion resistance, dimensional accuracy, etc. In the following, some specific examples are shown.

The present invention can be applied to metal products such as metals, intermediate products, final products, assemblies of them, and composite products combined with other materials in one of the forms of a plate, pipe, bar, wire bar or ingot; metals, intermediate products, final products, assemblies of them, and composite products combined with other materials which are worked by any working of welding, fusion welding, brazing, bonding, heat cutting, heat working, forging, extrusion, drawing, rolling, shearing, plate forming, roll forming, form rolling, spinning, bending, leveling, high-energy rate working, powder working, cutting or grinding is applied; and metals, intermediate products, final products, assemblies of them, and composite products combined with other materials, which are surface-treated by any working of metal coating treatment, chemical treatment, surface hardening, nonmetallic coating or painting is applied; and so on.

Also, the present invention can be applied to metal products such as automobiles, bicycles, large ships, small ships, rolling stock, airplanes, spacecrafts, elevators, playground vehicles, transport equipment, construction machinery, welding machines, metal dies, roller conveyers, heat exchangers, industrial machinery, keyboard instruments, wind instruments, percussion instruments, audiovisual equipment, gas and liquid controllers, home-electric equipment, sewing machines, knitting machines, playground equipment, electric outdoor equipment, electric indoor equipment, electric and electronic circuit packages, housing implements, building materials, external housing fixtures, internal housing fixtures, religious implements, precision machinery, optical instruments, measurement instruments, clocks and watches, writing implements, office supplies, plumbing implements, valves, faucets, decorations, accessories, sports articles, weapons, cans, receptacles, medical instruments, working tools, agricultural implements, construction tools, tableware, daily household utensils, groceries, daily sundries, gardening implements, gadgets or the like.

Also, the present invention can be applied to metal products such as transmission parts, engine parts, radiator parts, vehicle bodies, external vehicle parts, internal vehicle parts, driving system parts, brake parts, steering parts, air-conditioning parts, suspension parts, oil-hydraulic pump parts, ship outfit parts, instrument parts, gears, bearings, pulley, power couplings, pipe couplings, fuel pipes, exhaust pipes, gaskets, fuel nozzles, engine blocks, machine casings, moles, door handles, wipers, meter parts, alarm parts, air nozzles, axles, wheel bases, valves, pistons, masts, screws, propellers, fans, mechanical handles, gas welder parts, arc welder parts, plasma welder parts, welding torches, metal dies, bearings, mechanical sliding parts, heat-exchanger parts, boiler parts, solar water heater parts, musical-instrument pedals, resonator pipes, musical-instrument levers, musical instrument flames, kettle-drums, cymbals, audio amplifier parts, video player parts, cassette player parts, CD player parts, LD player parts, adjuster knobs, equipment legs, equipment chassis, speaker corns, hot-water supply system parts, electric water heater parts, pressure-reducing valves, relief valves, room heater parts, carburetors, room cooler parts, cooling medium pipes, service valves, flare nuts, hot-water storage vessels, gas piping, gas nozzles, burners, pump parts, washing machine parts, pinball parts, slot machine parts, automatic vending machine parts, coin slots, coin acceptors, control board parts, printed wiring parts, switch-board electrodes, switch parts, resistor parts, power plug parts, light bulb bases, lamp holder parts, discharge electrodes, water-immersed electrodes, copper wires, battery terminals, solders, architectural fitting parts, housing wall panels, reinforcing bars, building frames, door panels, door knobs, locks, hinges, gate poles, gate doors, fences, outdoor lamp shade, outdoor light poles, shutters, mailboxes, sprinklers, flexible tubes, rain-water gutters, roofs, handrails, cooker top plates, gas cooker burners, perforated water-distributing port plates, drainage plugs, door chains, hangers, sprinkling plates, fixing metals, towel bars, chandelier parts, illumination parts, artistic ornaments, chair legs, table legs, table leaves, furniture handles, furniture rails, shelf adjustment screws, family altar parts, Buddhist statues, candlesticks, bells, camera parts, telescope parts, microscope parts, electron microscope parts, lens mounts, lens holders, wristwatch parts, wall clock parts, table clock parts, watch and clock hands, clock pendulums, parts of ball-point pens, mechanical pencil parts, scissors, cutters, binders, paper clips, drawing pins, scales, rulers, cabinep, templates, magnets, document trays, telephone table parts, book ends, boring machine parts, stapler parts, pencil sharpener parts, cabinets, drain plugs, rigid vinyl chloride pipe joints, drainage ditches, elbow pipes, pipe joints, flexible joint bellows, water-supply and drainage cocks, water closet joint flanges, pierced earrings, stems, spindles, ball valves, balls, sheet rings, packing nuts, KCP joints, headers, branching cocks, flexible hoses, hose nipples, faucet bodies, faucet metal fittings, valve bodies, ball taps, stop cocks, single-function faucets, faucets with thermostat, two-valve wall faucets, skid-mounted two-valve faucets, spouts, UB elbows, mixing valves, pendants, finger rings, brooches, nameplates, tiepins, tie bars, bracelets, bag metals, shoes metals, clothing metals, buttons, zipper parts, hooks, belt metals, golf club parts, dumbbells, barbells, sailboat frames, trampoline frames, starting blocks, face guards for kendo, skate blades, ski edges, ski bindings, diving parts, sports gymnasium machines and equipment, bicycle chains, tent fixtures, pistol parts, rifle parts, matchlock parts, sword parts, bullets, fuel cans, paint cans, powder cans, liquid cans, gas cans, bed frames, surgical knives, endoscope parts, dental instrument parts, diagnostic instrument parts, medical operation instrument parts, therapeutic instrument parts, pliers, hammers, measures, gimlets, files, saws, nails, chisels, planes, drills, fixing tools, clams, whetstone bases, screws, bolts, nuts, machine screws, hose, axes, shovels, cooking pots and pans, kitchen knives, frying pans, ladles, spoons, forks, knives, can openers, corkscrews, frying turners, frying chopsticks, hot plates, kitchen strainers, scrubbing brushes, wastebaskets, litter baskets, pails, washbowls, sprinkling cans, cups, replicas, lighters, character goods, medals, bells, hair pins, hot curler, ashtrays, flower vases, keys, coins, fishing tackles, lures, glasses frames, nail clippers, pinball balls, insect baskets, umbrellas, needle point holders (frogs), needles, pruning shears, gardening poles, gardening frames, gardening trellises, flower baskets, thimbles, garden lanterns, cash boxes, and casters.

What is claimed is:

1. A brass which is a material for forging which comprises an apparent Zn content of 37 to 50 wt % and contains 0.5 to 7 wt % of Sn, wherein the brass has (i) a microstructure of an α phase, a β phase and a γ phase at a temperature region of 300 to 550° C., (ii) crystal grain sizes which are made fine, (iii) an area ratio of the α phase of 44 to 65%, (iv) an area ratio of the β phase of 10 to 55% and (v) an area ratio of the γ phase of 1 to 25%.

2. The brass according to claim 1, wherein average crystal grain sizes of the α phase and the γ phase are 15 μm or less.

3. The brass according to claim 2, wherein the α phase and the γ phase are present in dispersed states.

4. The brass according to claim 1, wherein average crystal grain sizes of the α phase, the β phase and the γ phase are 15 μm or less.

5. The brass according to claim 4, wherein the α phase and the γ phase are present in dispersed states.

6. The brass according to claim 1, wherein the α phase and the γ phase are present in dispersed states.

7. A process for preparing brass which comprises:

preparing a brass material having an apparent Zn content of 37 to 50 wt % and containing 0.5 to 7 wt % of Sn, the brass material having (i) a microstructure of an α phase, a β phase and a γ phase at a temperature region of 300 to 550° C., (ii) an area ratio of the α phase of 44 to 65%, (iii) an area ratio of the β phase of 10 to 55% and (iv) an area ratio of the α phase of 1 to 25%;

making the crystal grain size of the brass material fine and plastic working the brass material by heating to a temperature of 300 to 550° C.

8. The process for preparing brass according to claim 7, wherein the step of making the crystal grain size fine comprises subjecting the brass to (i) hot extrusion at a temperature of 300 to 650° C., and (ii) a reduction of area of 90% or more to provide an extruded brass material.

9. The process for preparing brass according to claim 8, which further comprises cooling the extruded brass material at a rate of 5° C./sec or more during the step of making the crystal grain size fine.

10. The process for preparing brass according to claim 9, wherein a fractional reduction in an upsetting height of said brass material during the plastic working us 40% or more.

11. The process for preparing a brass according to claim 8, wherein a fractional reduction of an upsetting height of said brass material during the plastic working is 40% or more.

12. The process for preparing brass according to claim 7, wherein the step of making the crystal grain size fine comprises cooling after heating the brass material, and during said cooling, a different phase is deposited in the crystal grain to make the crystal grain size fine.

13. The process for preparing brass according to claim 12, wherein a fractional reduction in an upsetting height of said brass material during the plastic working us 40% or more.

14. The process for preparing brass according to claim 7, wherein a fractional reduction in an upsetting height of said brass material during the plastic working is 40% or more.

* * * * *